US005386793A

United States Patent [19]

Gaudiano et al.

[11] Patent Number: 5,386,793

[45] Date of Patent: Feb. 7, 1995

[54] LINE HANDLING APPARATUS

[75] Inventors: Anthony V. Gaudiano; Will C. Cowan, Jr., both of Panama City, Fla.

[73] Assignee: Unisys Corporation, Blue Bell, Pa.

[21] Appl. No.: 108,405

[22] Filed: Aug. 18, 1993

[51] Int. Cl.[6] ..... B63B 21/04

[52] U.S. Cl. ..... 114/253; 89/1.14; 254/407

[58] Field of Search ..... 254/390, 407; 114/244, 114/245, 253

[56] References Cited

U.S. PATENT DOCUMENTS

| | | | |
|---|---|---|---|
| H105 | 8/1986 | Gould et al. | 89/1.14 |
| 972,254 | 10/1910 | Rotha | 254/407 |
| 1,263,898 | 4/1918 | Johannessen et al. . | |
| 1,319,565 | 10/1919 | Burney . | |
| 1,344,074 | 6/1920 | Williams . | |
| 1,358,358 | 11/1920 | Burney . | |
| 1,395,924 | 11/1921 | Magoon | 114/254 |
| 1,400,211 | 12/1921 | Burney . | |
| 2,119,697 | 6/1938 | Anderson . | |
| 2,396,686 | 3/1946 | Craig . | |
| 2,396,707 | 3/1946 | Kurtz . | |
| 2,422,506 | 6/1947 | Temple . | |
| 2,455,826 | 12/1948 | Temple . | |
| 2,543,079 | 2/1951 | Veek . | |
| 2,723,404 | 11/1955 | Krantz . | |
| 2,736,044 | 2/1956 | Lewis . | |
| 2,791,785 | 5/1957 | Metts . | |

(List continued on next page.)

OTHER PUBLICATIONS

*U.S. Navy Mine Countermeasures Familiarizer* (Naval Mine Warfare Engineering Activity, Yorktown, Va., Oct. 1991).

H. Thompson, ed. *The Book of History: The World's Greatest War,* vol. XVII, pp. 470–476 (The Grolier Society, New York, 1920).

*Primary Examiner*—David Brown

*Attorney, Agent, or Firm*—Stanton D. Weinstein; Mark T. Starr

[57] ABSTRACT

A mine countermeasure device includes a passthrough mechanism and a mine neutralization package. The passthrough mechanism includes a first wheel with a raised rim and at least one radially oriented slot or notch, a clevis member rotatably engaging the axle of the first wheel, and a bail member slidably engaging the underside of the rim. A smaller wheel is pivotably connected at its axle to an angled member extending from the neutralization package. The neutralization package also includes a collapsed float, a gas generator to inflate the float, explosives to neutralize a mine, and an electric detonator for the explosives. The passthrough device is towed underwater by a sweep wire connected to the clevis member and to the bail member. When the sweep wire encounters a mine mooring, the sweep wire is pulled along the mooring until the mooring enters a slot of the first wheel. Continued forward motion of the sweep wire causes the first wheel to rotate, passing the wire between the clevis member and the bail member until the smaller wheel is reached. A radially oriented slot or notch of the smaller wheel then moves onto the mooring. The smaller wheel then rotates with the mooring so that the mooring passes the passthrough device and the sweep wire. The neutralization package and the smaller wheel are now disposed about the mine mooring. The mooring then engages the angled member, so that the neutralization package and the smaller wheel are pulled off the passthrough mechanism, activating a switch on the package. The switch triggers inflation of the float and enables subsequent detonation of the explosives. For other applications than mine countermeasures, the neutralization package can be replaced with other equipment to be provided to or about a line.

14 Claims, 28 Drawing Sheets

FOREIGN PATENT DOCUMENTS

| | | | |
|---|---|---|---|
| 2,978,796 | 4/1961 | Kemeny | 29/156.8 |
| 3,120,827 | 2/1964 | Abegg et al. | 113/44 |
| 3,175,289 | 3/1965 | Wilterdink et al. | 30/180 |
| 3,742,440 | 6/1973 | Ehrlich et al. | 343/225 |
| 3,755,837 | 9/1973 | Temple et al. | 114/221 A |
| 3,763,512 | 10/1973 | Valihora | 114/20 |
| 3,844,244 | 10/1974 | White | 114/221 A |
| 3,848,226 | 11/1974 | Perez | 294/83 AE |
| 3,850,075 | 11/1974 | Temple | 114/221 A |
| 3,882,811 | 5/1975 | Temple | 114/221 A |
| 3,931,726 | 1/1976 | Grubb | 72/430 |
| 4,020,780 | 5/1977 | Shumaker et al. | 114/221 A |
| 4,112,862 | 9/1978 | Huly et al. | 114/221 A |
| 4,120,246 | 10/1978 | Sabranski et al. | 114/221 A |
| 4,126,092 | 11/1978 | Cross | 102/24 HC |
| 4,128,071 | 12/1978 | Layman et al. | 114/221 A |
| 4,185,550 | 1/1980 | Vogt et al. | 102/13 |
| 4,327,471 | 5/1982 | Whitted, III | 29/421 |
| 4,495,849 | 1/1985 | Cooke et al. | 89/1.14 |
| 4,606,293 | 8/1986 | Kirkland | 114/221 A |
| 4,625,631 | 12/1986 | Vera | 254/407 |
| 4,696,234 | 9/1987 | Kaltmann et al. | 102/308 |
| 4,970,957 | 11/1990 | Backstein et al. | 102/403 |

LINE HANDLING APPARATUS

FIELD OF THE INVENTION present invention relates to line handling apparatus. The present invention also relates to mine-neutralizing and mine-destroying devices, mine countermeasures, and antiminesweep devices.

BACKGROUND OF THE INVENTION

In the field of naval warfare, there is a need to neutralize mines moored underwater. The present invention fulfills this need.

The role of mines in naval warfare is well-known. For example, during World War I, mines were laid by the Turks in the Dardanelles to frustrate an Allied fleet seeking to pass through that strait to attack Constantinople. The presence of these mines, the inability of the attacking Allied fleet to remove them, and the sinking by mines of some Allied warships in an area (Eren Kui Bay) previously thought neutralized, led to the bloody but unsuccessful invasion of the inhospitable Gallipoli peninsula. More recently, during Operation Desert Storm, mines damaged USS Princeton and USS Tripoli.

One type of mine that is deployed in water is the moored mine, also known as a tethered mine. Such mines generally consist of a buoyant explosives package having appropriate detonator(s), an anchor, and a mooring cable or chain (also called a mooring or a tether) which connects the two. The mooring tethers the mine so that the mine is suspended at some depth. Moored mines commonly have a clump anchor and a mooring that are deployed from a floodable housing at the bottom end of the mine. The mine is kept submerged to reduce its detectability, but is kept close enough to the surface of the water to substantially damage or destroy a surface vessel or a submerged vessel that causes the mine to detonate. The mine detonation may be caused by physical contact by magnetism of the vessel's steel hull, by acoustic noise from propellers, and by pressure. Some mines use a variety of triggers, and can discriminate between levels of the above factors (e.g. due to desired size of the target vessel). Obviously, the mooring is held substantially vertically (subject to currents and other factors) between the anchor and the explosives package. Such mines can be deployed or sown from a surface vessel or a submarine, or can be dropped from aircraft.

In the prior art, moored mines would be removed by a variety of means, but commonly by a specialized ship called a minesweeper, which is constructed of materials that would not cause, or would at least substantially reduce the likelihood of, actuating a mine's magnetic trigger that could detonate the explosives package of the mine. Such a ship would tow a sweep wire at a depth at which the mine mooring would be expected to be present. Alternatively, the wire sweep can instead be towed by a helicopter, which can arrive at a mined location several miles distant faster than can a ship. One such helicopter-towed sweep wire arrangement is illustrated at FIGS. 1 and 2 of U.S. Pat. No. 4,020,780 issued May 3, 1977 to Richard K. Shumaker et al., which is hereby incorporated by reference herein. A diverted sweep wire array armed with cutters is used to sweep moored mines. Each wire is diverted to one side. A depressor is used to maintain the wires at a desired depth. The sweep wire is used to cut the mooring, causing the mine to rise to the surface for neutralization, e.g.

destruction. Gunfire is generally used for this purpose. Unfortunately, the released mines while floating on the surface are generally sufficiently small that, especially in the presence of sea waves or darkness, they are difficult to visually detect and destroy.

Conventional minesweeping only cuts the mooring. The freed mine floats to the surface where it is commonly neutralized by gunfire, usually requiring a second vessel. Presently, conventional minesweeping can therefore only be performed during periods of good visibility, a severe tactical limitation. Floating mines that escape neutralization present a danger to the minesweeper(s) and other marine assets. If the mine mooring is not severed, the mine will likely be pulled down and over the sweep wire. This presents a serious problem to the minesweeper and its crew when the conventional sweep gear is recovered.

The minesweeper generally has a wood or fiberglass hull. The minesweeper has on its stern winch(es) of a non-magnetic material from which one or more non-magnetic cables are deployed. Such cables, called sweep wires, are towed behind the minessweep in a combined inverted single or full V configuration. Along the weep wire are located a series of mooring cutters. This V shape may be about 100 yards across at its rear. The sweep wires are held below the water surface by a depressor wire provided with one or more depressors, and is held relatively horizontal in the water by devices called otters, assisted by one or more floats which are usually at the free ends of the sweep wires to mark their location. A paravane can be used to divert each wire to port or starboard of the tow. Each sweep wire can be two or more wires, each towed behind and to one side (port or starboard) of the minesweeper to together form an inverted V shape. Disposed along the length of the sweep wire at regular intervals are mooring cutters. One such cutter employed by the U.S. Navy is called "Cutter, Powder Activated, Minesweeping Mark 17 Mod. 1". This cutter has a chisel with a 44 magnum shotgun shell or similar and a small trip wire. When the mine mooring comes up against the trip wire, it releases a trigger which fires the shotgun shell to propel the chisel out and cut the mooring, thereby releasing the mine to float up to the surface. Other cutters were coated with particles of diamond or had sharpened files for sawing at the mine mooring. Such cutters are described in U.S. Pat. No. 3,844,244 issued Oct. 29, 1974 to William B. White, and in U.S. Pat. No. 4,120,246 issued Oct. 17, 1978 to Udo Sabranski et al., which are each hereby incorporated by reference herein. If a moored mine is encountered, then as the sweep wire is pulled through the water, the mine mooring runs along the sweep wire until a cutter is encountered which cuts the mooring. Such sweep apparatus is described in *U.S. Navy Mine Countermeasures Familiarizer* produced by the Naval Mine Warfare Engineering Activity, Yorktown, Va. (October 1991) which is hereby incorporated by reference herein.

One problem that has been encountered with cutters is that of marine growth. This marine growth can be seaweed, stringy or large leaf grass, or calcareous. Such growth can foul a cutter.

When a cutter cuts the mine tether, the mine floats up to the surface. Usually another vessel neutralizes the mine, with gunfire, such as from 50 caliber machine guns, when the minesweeper is well away. Thus, two vessels are commonly used for this purpose. Thus, minesweeping is dangerous in bad weather, and extremely difficult if not impossible at night. If the floating mine is exploded when the sweep gear is nearby, the sweep gear could be destroyed or disturbed sufficiently that sweeping operations would have to be stopped and repairs or readjustments made. If the mine case is penetrated, then the mine will flood and sink. If the charge or the detonator of the mine are not neutralized, then when the minesweep crew retrieves their sweep gear, they may find a live mine therein, obviously an undesirable situation.

It is also desirable that mines sown by friendly forces, such to impede movement of enemy vessels, evade such sweep efforts. The passthrough mechanism of the present invention also fulfills this need.

SUMMARY OF THE INVENTION

Accordingly, an object of the present invention is to provide apparatus to allow a line such as a tensioned cable to pass through it.

Another object of the present invention is to provide apparatus for providing equipment to a line such as a tensioned cable.

A further object of the present invention is to provide a pass-through device to attach a package to a mooring without cutting the mooring.

Still another object of the present invention is to provide a moored mine countermeasure device which is capable of neutralizing a moored mine in one pass, in poor as well as good visibility and in rough as well as smooth water, and without need for additional marine assets.

Yet another object of the present invention is to provide a moored mine countermeasure device that can be used by surface and airborne minesweep assets.

A still further object of the present invention is to provide a moored mine antisweep device for preventing or resisting sweeping of a mine by, and frustrating operation of, a sweep device such as an enemy sweep device, making friendly moored mines resistant to being swept.

Briefly, these and other objects of the present invention are accomplished by a device for passing through a vertical mooring cable or other line. This device includes a wheel having a rim and at least one slot. The wheel is rotatably supported by a clevis attached to the wheel axle, and by a bail slidably or rotatably engaging the rim of the wheel. The bail can slidably engage the rim of the wheel with a smooth material such as a plastic. The bail can alternatively engage the rim of the wheel via captive rollers. If the device is towed, then upon capture of the line by the slot, the wheel rotates with the cable. The cable is thereby provided to a location where it causes release of an apparatus to be provided to the line, such as a neutralization package for sea mines. In the towed configuration, the wheel is preferably oriented substantially perpendicular to the line. This device, when swept through a mine field, provides a method for attaching a package to a mine for neutralization and/or location of the mine at some later time. Deployed from a sweep wire, the device allows the sweep wire to pass through the mooring cable as it attaches a neutralization/location package around the mooring cable. The package then floats up the mooring cable to the mine for neutralization/location purposes. Once the package is attached to the mine it can be activated out of range of the resulting explosion thereby eliminating danger to the vessel and sweep gear.

The device can instead be connected to the line to avoid engagement of the line by a perpendicularly oriented sweep wire; for such a configuration, the sweep wire would engage the wheel slot, but the wheel is rotated by the wire to move the sweep wire between the bail and clevis and so past the line. In this second configuration, the wheel is preferably oriented with the line.

Other objects, advantages and novel features of the invention will become apparent from the following detailed description of the invention when considered in conjunction with the accompanying drawings.

BRIEF DESCRIPTION OF THE DRAWINGS

In the drawings,

FIG. 8 shows one example of relative positions of the device of FIGS. 3 and 4, a sweep wire attached thereto, a moored mine and its moored tether during an approach of that device and the sweep wire to the tether;

FIG. 9 shows one example of relative positions of the device of FIGS. 3 and 4 and a mine tether just before capture of the tether by the device;

FIG. 10 is a plan view showing one example of relative positions of the device of FIGS. 3 and 4 and a mine tether captured in the slot of the device;

FIG. 11 is a plan view showing one example of rotation of a wheel of the device of FIGS. 3 and 4 caused by relative movement of that device with respect to a mine tether captured therein;

FIG. 12 shows one example of a subsequent stage of operation of the device of FIGS. 3 and 4, showing a mine tether engaging another wheel of the device;

FIG. 13 shows one example of a subsequent stage of operation of the device of FIGS. 3 and 4, after rotation of the other wheel of FIG. 7 due to relative movement of the device with respect to the captured mine tether;

FIG. 14 shows one example of release of an apparatus from and its movement past the device of FIGS. 3 and 4;

FIG. 15 shows one example of a subsequent stage of operation of the device of FIGS. 3 and 4, showing a further stage of deployment of the apparatus of FIG. 14 to be provided to the mine and its tether;

FIG. 16 illustrates one embodiment of the deployable apparatus of FIGS. 14 and 15 deployed on the mine tether;

FIG. 17 shows one example of another stage of operation of the device of FIGS. 1 and 2, with the apparatus of FIG. 12 rising along the mine tether towards the mine;

FIG. 18 shows one example of a subsequent stage of operation wherein the apparatus of FIG. 12 has risen along the mine tether to just below the mine and has detonated to destroy the mine;

FIG. 19 shows the device of FIGS. 3 and 4 approaching a mine mooring;

FIG. 20 shows the mine mooring engaged by a portion of the device of FIGS. 3 and 4;

FIG. 21 shows rotation of a wheel of the device of FIGS. 3 and 4 due to the mooring;

FIG. 22 shows one example of a subsequent stage of operation of the device of FIGS. 3 and 4;

FIG. 23 shows one example of a more subsequent stage of operation of the device of FIGS. 3 and 4;

FIG. 24 shows one example of a still subsequent stage of operation of the device of FIGS. 3 and 4, wherein a portion of the device of FIGS. 3 and 4 has been provided to the mooring and removed from the rest of the device;

DESCRIPTION OF THE PREFERRED EMBODIMENTS

Figure 1:
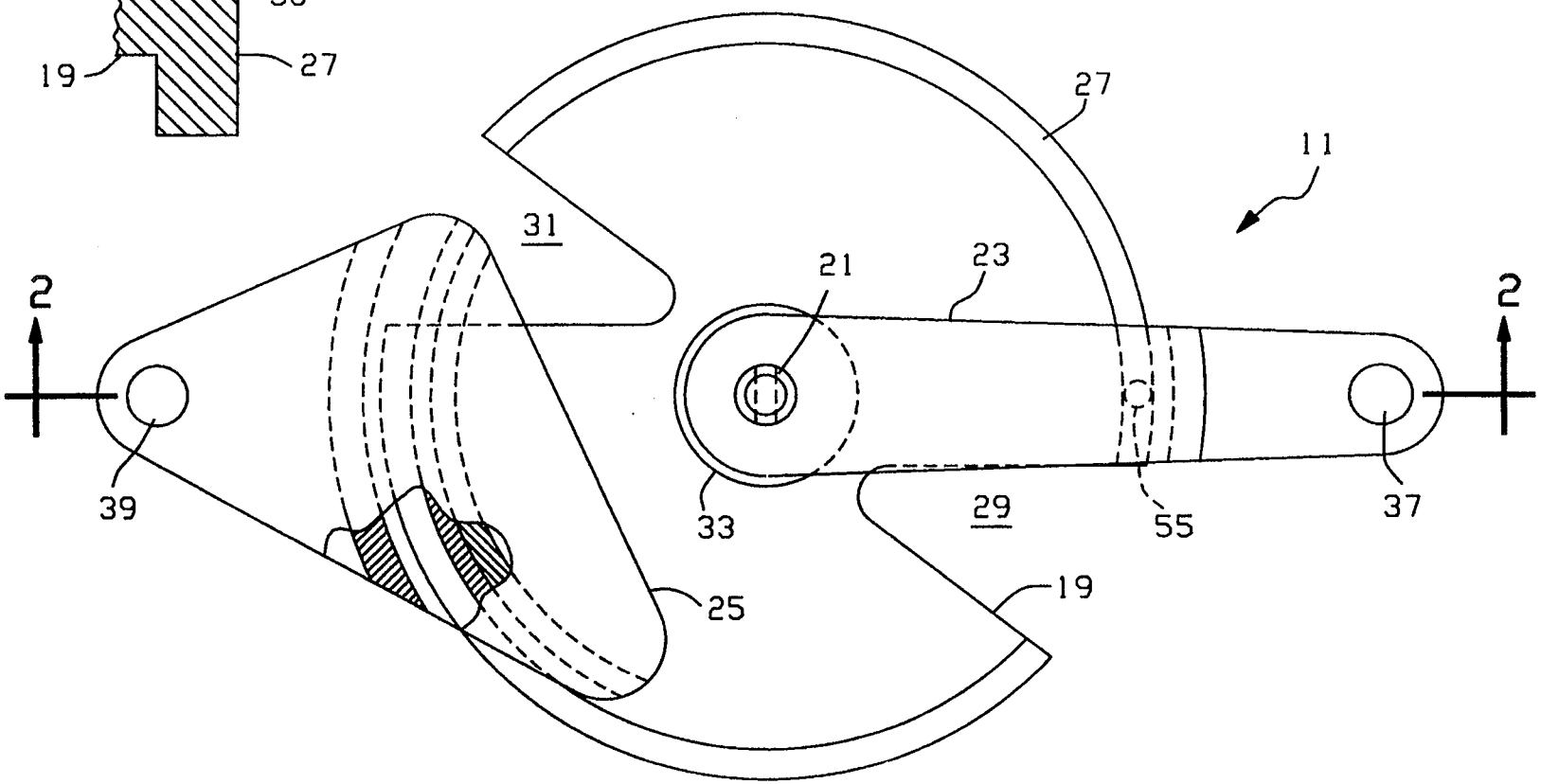
FIG. 1 is a plan view of one embodiment of a line passthrough device according to the present invention.
Figure 2A:
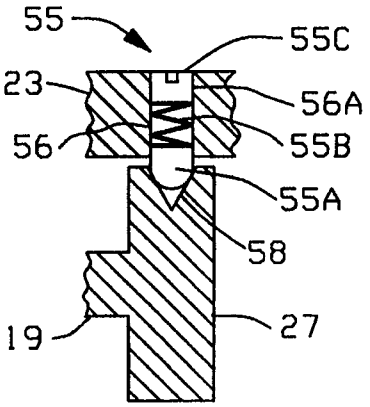
FIG. 2A shows a portion of FIG. 2 in greater detail.
Figure 2:
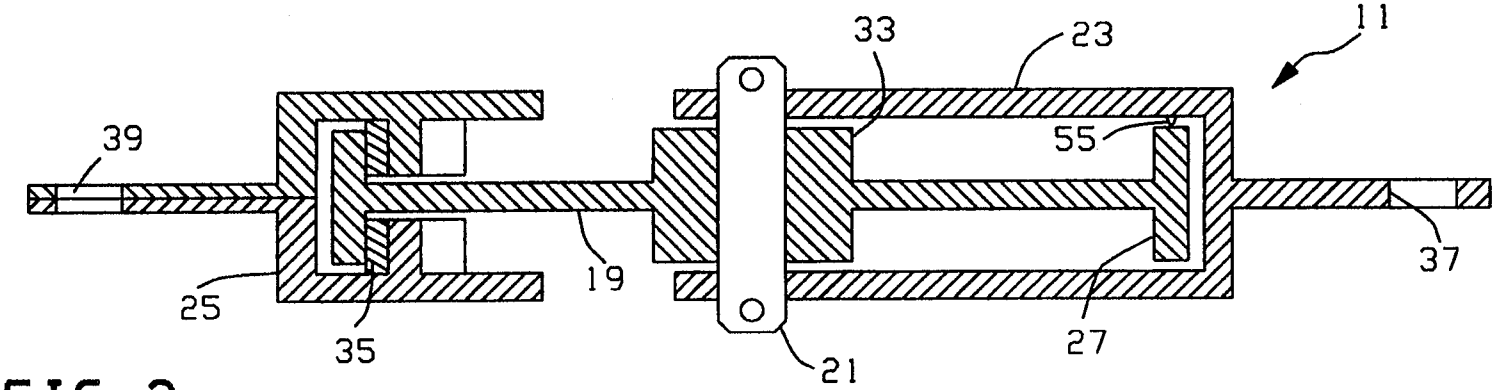
FIG. 2 is a section of the device taken on the line 2—2 of FIG. 1 and looking in the direction of the arrows.

Referring now to the drawings, wherein like reference characters designate like or corresponding parts throughout the several views, there is shown in FIGS. 1 and 2 a line passthrough device 11. Passthrough device 11 includes a wheel 19, its axle 21, clevis 23 engaging the axle, and bail 25 engaging wheel rim 27. Wheel 19 is provided with a rim 27 (here illustrated as a T-shaped rim), at least one radially disposed slot 29, and a central hub 33 about axle 21. Wheel 19 can have any number of slots, but must have at least one. Two such slots 29 and 31 are illustrated here, and would permit handling of successive lines, as discussed below. Each such slot 29 and 31 opens radially outwardly, like a sector of a circle or a piece of pie, but need not have its apex extend to hub 33 or axle 21 of wheel 19. Wheel 19, axle 21 and clevis 23 are so relatively positioned that wheel 19 can freely turn on its axle 21 and so move slots 29 and 31 with respect to clevis 23 and bail 25. As can be more clearly seen in FIG. 2, bail 25 at its surface engaging wheel rim 27 is provided with a slippery surface 35 to permit free movement of wheel 19 with respect to bail 25. For example, at least that portion of bail 25 engaging rim 27 can be coated 35 with Teflon ® or other synthetic resin polymer or polymer product that provides a smooth, slippery surface. Clevis 23 is provided with a hole 37, and bail 25 is provided with a hole 39, by which passthrough device 11 can be attached to a line (not shown).

Figure 4:
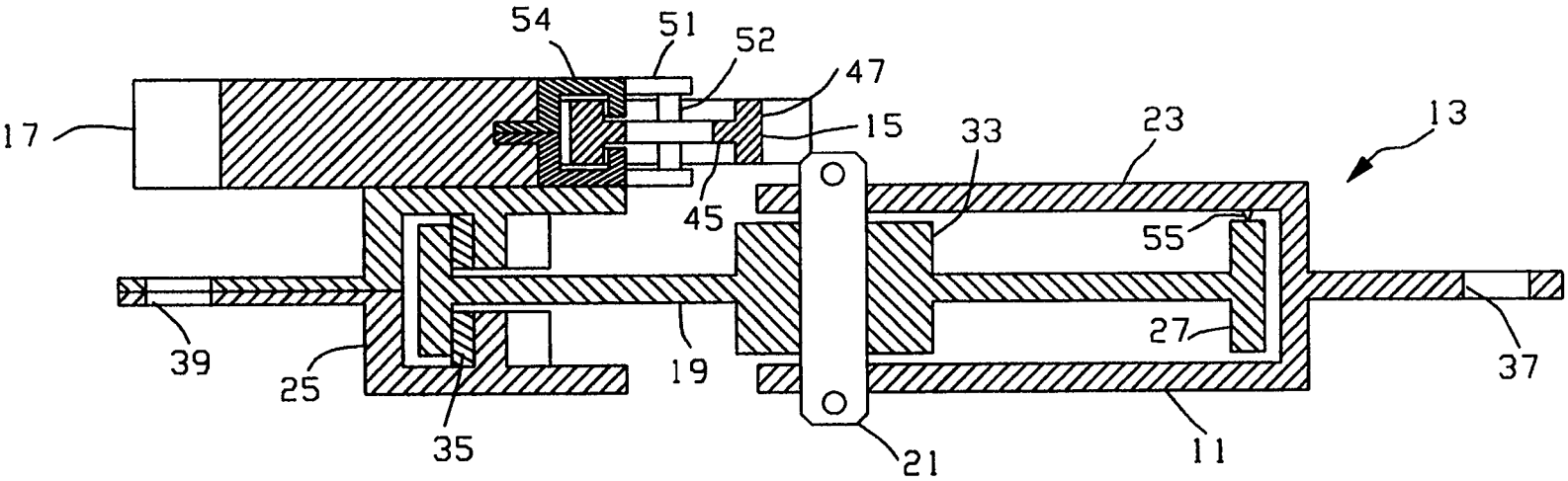
FIG. 4 is a section of the device taken on the line 4—4 of FIG. 3 and looking in the direction of the arrows but with cable removed.
Figure 3:
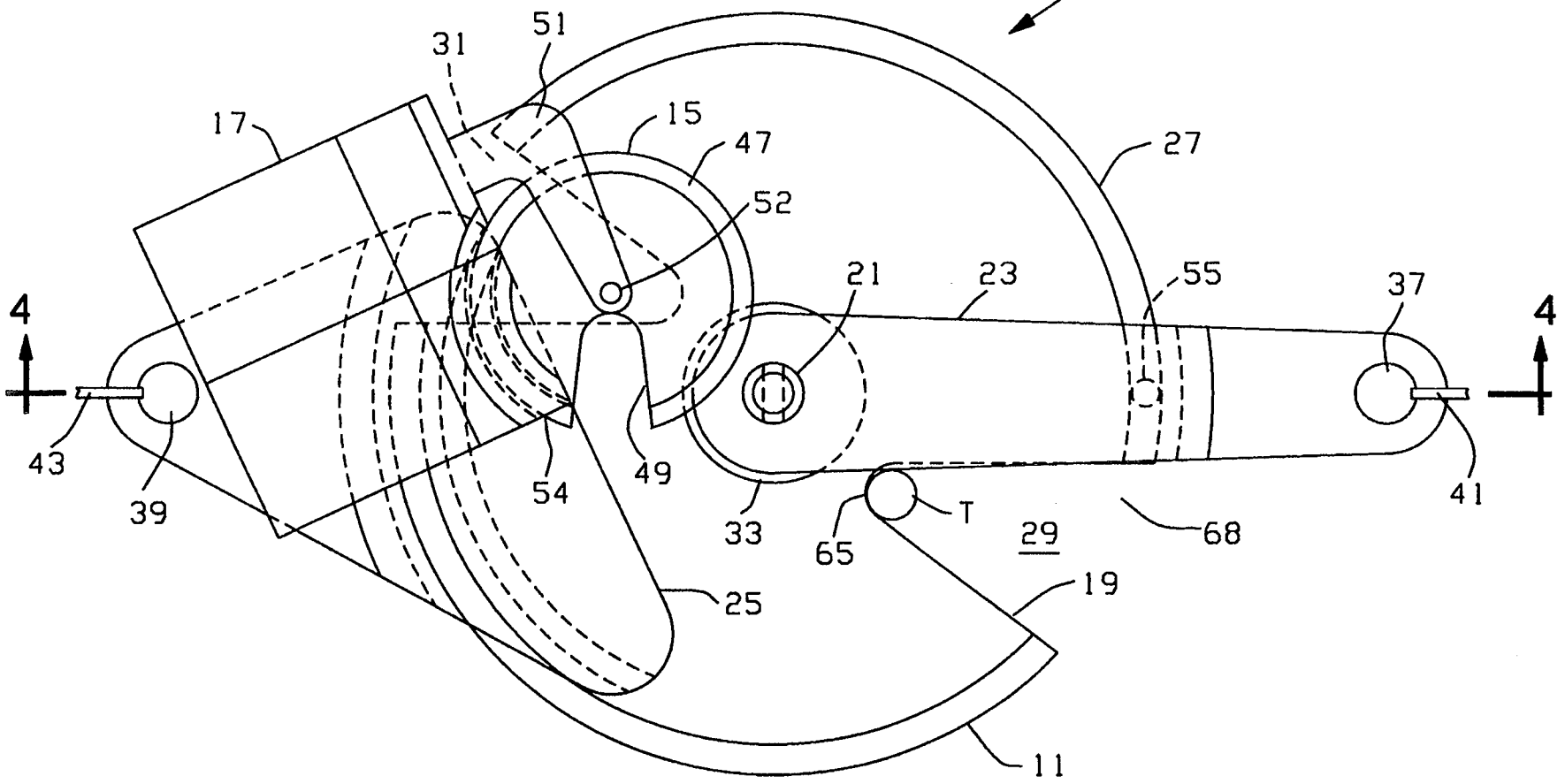
FIG. 3 is a plan view of one embodiment of a moored mine countermeasure device according to the present invention.
Figures 6, 7:
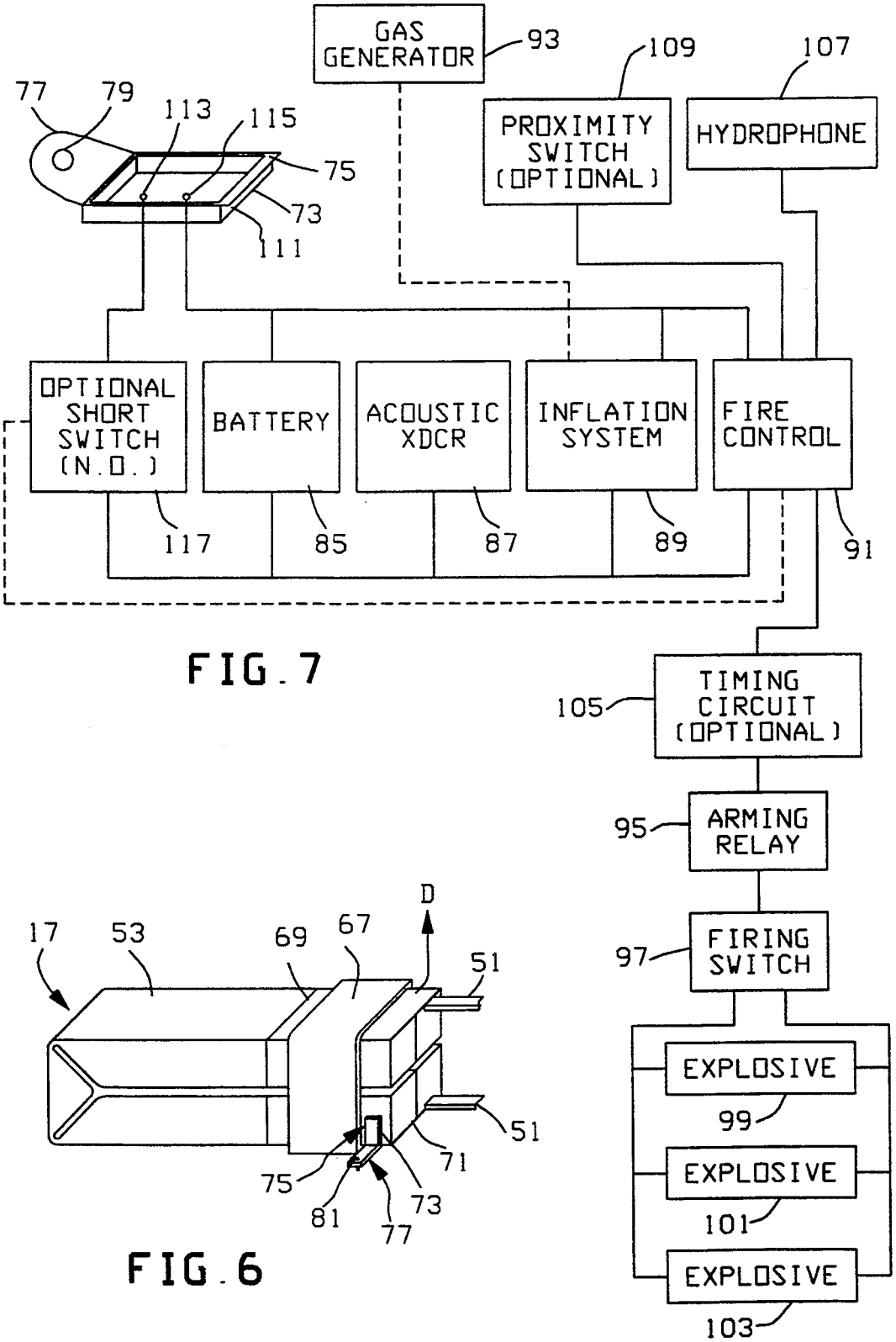
FIG. 6 illustrates in greater detail the neutralization package of the device of FIGS. 3 and 4.
FIG. 7 is a diagrammatic representation of the electric circuitry of the neutralization package of FIG. 6.

There is shown in FIGS. 3 and 4 a moored mine countermeasure device 13 including a passthrough device 11 as in FIGS. 1 and 2, and a neutralization package 17. Moored mine countermeasure device 13 can also be described as a moored mine hardkill device. In FIGS. 3 and 4, clevis 23 is provided with a hole 37, and bail 25 is provided with a hole 39, by which passthrough device 11 can be attached to a sweep wire 41, 43. Device 13 also includes a wheel 45 provided with a rim (preferably a T-shaped rim) 47 and at least one radially oriented slot 49. Slots 29, 31 and 49 are each configured to receive a mine mooring line or tether T. As illustrated, turning of wheel 45 by approximately 120 degrees will free tether T from passthrough device 11. Tether T can then cause release of neutralization package 17 from device 13 so that deployment of the package about tether T can commence. As shown in FIG. 6, neutralization package 17 includes a case 69, a case 71 and a float 53. Neutralization package 17 also includes an explosives package contained within cases 69, 71 and float 53 and thus not seen in FIGS. 3 and 4. The explosives package includes suitable explosive(s) and preferably two detonators for same. Neutralization package 17 can also be provided with a pinger or a similar signal transmitter or homing device, triggered by deployment of the neutralization package 17. One or more such moored mine countermeasure devices 13 could be attached along and towed by a single sweep wire. Each such passthrough device 11 is provided with its own mine neutralization package 17. The device engaging tether T is a pass-through mechanism 11, and includes a wheel 19 having at least one slot or gap 29, a clevis 23 rotatably connected to the center of that wheel by an axle 21, and a bail 25 slidably engaging the rim 27 of wheel 19. Wheel 19 is provided with a raised or T-shaped rim 27 that is slidably or rotatably engaged by the bail 25. A detent 55 on and inside clevis 23 resists rotation of wheel 19 to hold the slot 29 in place facing the direction of translational movement of the sweep wire 41, 43 and wheel 19, so that wheel slot 29 will engage any mine mooring cable or tether T that wheel 19 there encounters. As shown in FIG. 2A, detent 55 includes a ball nose detent 55A, spring 55B, and spring retainer 55C retained in threaded portion 56A of hole 56 in clevis 23. Spring 55B urges ball nose detent 55A into depression 58 in rim 27.

Figure 5:
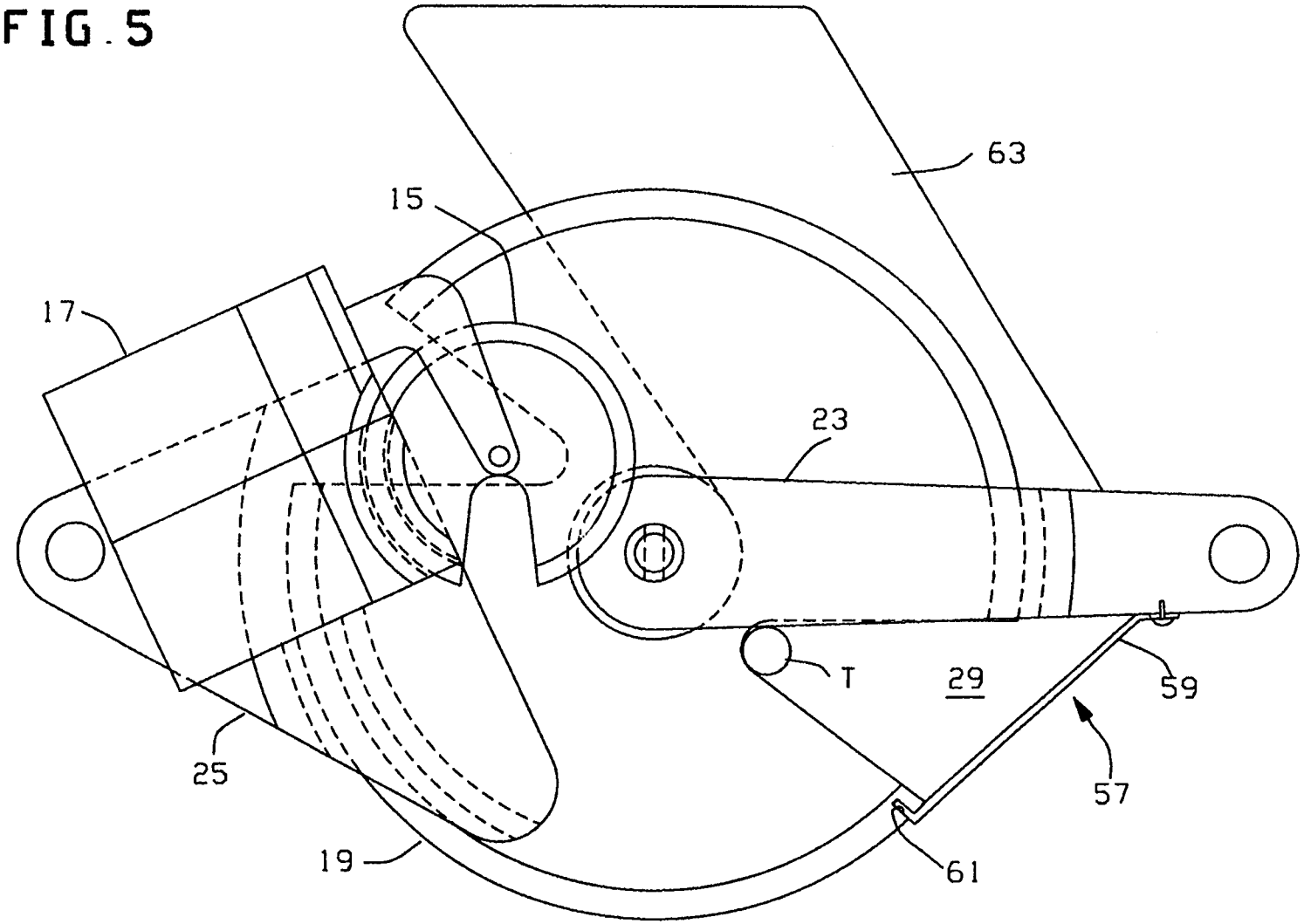
FIG. 5 is a plan view of another embodiment of a moored mine countermeasure device according to the present invention.

If marine growth is a significant concern in the watery environment in which a moored mine is being swept using the present invention, then the configuration of FIG. 5 would be preferred. Slot 29 is pulled by sweep wire 41, 43 through the water in a direction with its open end 68 at rim 27 moving in the forward direction of movement of moored mine countermeasure device 13. Accordingly, a small spring steel guard 59 can be added which is selected to be depressed by the force of the mooring T on the sweep wire 41, 43 and on the guard but which fends off marine growth and the like. As shown in FIG. 5, there can preferably be added to passthrough device 11 a sea grass deflector 57 that is located at the face of each slot 29, 31, but is here illustrated only for slot 29. This deflector 57 includes a leaf spring 59 with its tip in a hole 61 in the rim 27 of wheel 19. Sea grass being moved down the sweep wire 41, 43 will not have enough force to deflect the spring 59. However, the force of the mooring T is great enough to deflect the spring 59 out of the hole 61 in the rim 27. The mooring T will then go into the notch 29. Inclusion of deflector 57 is preferred for mine countermeasures, minesweep countermeasures, and undersea applications. The tension of the spring 59 resists deflection by sea grass but cannot resist the stronger force applied by the mooring T. Such engagement would result in sufficient force being applied by the mooring T to passthrough device 11 to cause wheel 19 to rotate about its axle 21 notwithstanding the detent on clevis 23.

As an alternative to guard 57, pass-through device 11 at least at slots 29 and 31 could be constructed of beryllium copper which is poisonous to relatively simple marine growth, so that wheel 19 itself would not foul for a relatively long time.

Passthrough device 11 is connected to, and is held suspended from, sweep wire 41, 43 by appropriate eyelets or the like 37, 39 respectively formed in clevis 23 and bail 25. A fin 63 on clevis 23 keeps the attitude of passthrough device 11 horizontal while countermeasure device 13 is being towed by the minesweeper, helicopter or other vehicle. Bail 25 is provided with a releasable spring-type holder or clasp 67 which releasably holds neutralization package 17 on passthrough device 11. Device 13 movement relative to mooring cable T causes mooring T to cause release of neutralization package 17 from holder 67.

Neutralization package 17 in one embodiment includes a toroidal (donut-shaped) collapsed float for the mine, a source of gas pressure to inflate the float, an explosive device to destroy the mine, and an acoustic or radio pinger to enable detection of the mine should the explosive malfunction.

In use, several countermeasure devices 13 could be connected, at various locations, to a sweep wire. When a passthrough device 11 is towed into and against a mine mooring T, the cable enters the wheel slot 29 and becomes lodged at the inner end or apex 65 of that slot. Continued forward movement of the sweep wire 41, 43 causes the mooring cable T to rotate wheel 19 (despite the detent 55 on clevis 23), to reach and then rotate wheel 45, until the cable engages and moves against angled member 51, thereby releasing neutralization package 17 from holder 67. Neutralization package 17 upon release inflates float 53. Float 53 then moves up the mooring cable T to just beneath or against the mine M. The explosive is provided with appropriate detonator(s) to destroy or at least neutralize the mine.

Countermeasure devices 13 are preferably connected at intervals in a sweep wire 41, 43. Each countermeasure device 13 includes a pass-through mechanism 11 and a neutralization package 17. Passthrough mechanism 11 includes a wheel 19 which is supported at its hub 33 by an axle 21 and a clevis 23. Clevis 23 is connected via hole 37 to sweep wire 41. Wheel 19 has a T-shaped rim 27 and a radial open slot 29. A portion of the underside of rim 27 on each side is in contact with surface 35 of bail 25 at any one time. The other end of bail 25 is connected via hole 39 to the sweep wire 43. A fin 63 on clevis 23 causes countermeasure device 13 to assume a horizontal attitude as sweep wire 41, 43 moves through the water. Neutralization package 17 is stowed in a rear facing clasp or holder 67 fixed on bail 25. Neutralization package 17 includes a tube of elastomeric material which contains internally, a cylinder of gas, redundant fuses, explosives, and a miniature acoustic or radio pinger. As the mooring T is moved through the mechanism 13 by sweep wire 41, 43, mooring T enters a linkage 15 for neutralization package 17. This linkage 15 includes wheel 45, angle member 51, and axle 52 connecting wheel 45, member 51, and a slippery portion 54 of case 71 engaging rim 45. As mooring T pulls package 17 out of its holder 67, the float 53 of the package inflates and floats (with the rest of package 17) up the mooring to the mine M. After an arming sequence, either of the preferably redundant fuses detonates the explosives. If there is a misfire, then the pinger marks the location of the mine so that the mine can be neutralized otherwise, e.g. by gunfire.

Countermeasure device 13 includes passthrough mechanism 11 and neutralization package 17. Such countermeasure devices 13 are in one embodiment connected at intervals in a minesweep wire such as wire 41, 43. As the sweep wire moves through the water, a fin 63 on clevis 23 orients device 11 to a near horizontal position. When the sweep wire encounters a mine mooring T, the mooring is forced along the sweep wire and into passthrough mechanism 13. The passthrough mechanism 13 entrance 29 is then automatically blocked by rim 27 against other moorings, which could then be handled by other devices 13 on that sweep wire. As the mooring moves through mechanism 11, a neutralization package 17 self-attaches to the mooring. Neutralization package 17 is activated as the package is pulled off passthrough mechanism 11 by mooring T. Package 17 becomes buoyant, rises up the mooring to the mine, and detonates. The configuration and trim of the inflated package 17 allows it to overcome extensive marine fouling, if any is present. If the explosives in package 17 fail to detonate, the mine location is still marked by acoustic or radio signals from package 17 to facilitate neutralization of the mine by other means such as gunfire.

Passthrough mechanism 11 includes a wheel 19 with a T-shaped rim 27. Wheel 19 is supported by a clevis 23 and a bail 25. A radial open slot 29 is in wheel 19. At rim 27, slot 29 is of a width to accommodate a mine mooring. Slot 29 is soft pinned to clevis 23 by detent 55 to ensure that slot 29 is oriented to initially accept the mooring as it is moved down the sweep wire.

A clevis 23 and axle 21 support wheel 19 at its center. The other end of clevis 23 is attached to sweep wire 41 via hole 37. A fin 63 on clevis 23 is used to rotate passthrough mechanism 13 to a horizontal attitude as the sweep wire 41, 43 moves through the water. A bail 25 encompasses a segment of wheel rim 27 at any one time, and there hooks around the underside of the rim on each side. A portion 35 of the hook of bail 25 is slidably in contact with a segment of the underside of wheel rim 27. The other end of bail 25 is attached via hole 39 to sweep wire 43. In operation, a moor entering countermeasure device 13 rotates wheel slot 29, thereby automatically blocking (using rim 27) the entrance to passthrough mechanism 11 to any other moors until countermeasure device 13 is rearmed. Bail 25 carries a neutralization package 17 in a side opening holder 67. Neutralization package 17 is removed by the mooring T as it moves through pass-through mechanism 11.

Neutralization package 17 includes a compartmented tube or float 53 of reinforced elastomeric material. Tube 53 contains a valved gas bottle, redundant fuses, redundant explosives, and a miniature battery activated pinger. The ends of tube 53 are sealed, and are attached to a smaller pass-through mechanism 15. Pass-through mechanism 15 can have a maximum number of slots, to ensure that it engages the mooring T. As package 17 is removed by the mooring, gas is released inside tube 53 causing the tube to inflate. Simultaneously, parallel fuses are activated and the circuit to the battery of a pinger exposed to the water is completed. The shape of the inflated float 53 is roughly that of a toroid with a gap bridged by passthrough mechanism 15. The weight distribution, section diameter, and inflated shape of the package 17 facilitates ascent up the mooring T even in the presence of calcareous marine growth. Float 53 is sized to transport a suitable weight of explosives. After an arming sequence, either fuse detonates the explosives. If the explosives fail to detonate, then the pinger marks the location of the mine for disposal by other means such as gunfire.

Variations of countermeasure device 13 within the practice of the present invention include the deployment of multiple neutralization packages from a single mechanism, or utilization of a neutralization package with remotely controlled multi-arming means. For such configurations, it would be preferred that wheel 19 be provided with two oppositely disposed slots 29 and 31. In such a configuration, when one such slot has moved a mooring through wheel 45, the other, antipodal slot is positioned to receive another mooring.

Countermeasure device 13 could be fitted with a magazine having multiple neutralization packages and thereby extend its operational capability.

Pass-through mechanism 11 includes a clevis 23, a rimmed wheel 19, and a bail 25 that grasps the wheel rim 27. Wheel 19 is detented 55 in position from clevis 23 so that slot 29 in wheel 19 will intercept a mooring as the sweep wire 41, 43 pulls against the mooring. When the mooring enters slot 29, the movement of the sweep wire 41, 43 causes wheel 19 to rotate and brings the mooring through a smaller pass-through mechanism 15 of neutralization package 17. This captures the mooring in neutralization package 17. The movement of the sweep wire pulls the neutralization package 17 free of pass-through device 11, and float 53 of package 17 begins to inflate.

When tether T is encountered by passthrough device 11, the tether enters slot 29 of wheel 19 and the forward motion of towed sweep wire 41, 43 with the rest of the towed sweep gear causes wheel 19 to rotate because the mooring is stationary or at least relatively stationary with respect to passthrough device 11. Tether T may be deflected somewhat when impacted by sweep wire 41, 43, but the tether is relatively stationary. Movement of sweep wire 41, 43 with respect to tether T causes wheel 19 to rotate. With this rotation, as slot 29 passes through bail 25, tether T is now on the other side of sweep wire 41, 43. Bail 25 allows the mooring to pass through the sweep wire 41, 43 at pass-through device 11. This is because bail 25 clasps around the edge of rim 27 of wheel 19. Tether T moves past the end of bail 25 because the tether is firmly at the apex or inner end 65 of slot 29 because of the movement of sweep wire 41, 43. When wheel 19 thereby rotates, tether T passes to the other side of, and out of, pass-through device 11. Mooring tether T thus becomes on the opposite side of sweep wire 41, 43. Tether T goes into slot 29 of wheel 19. Wheel 19 rotates while the tether is at the apex 65 of slot 29. Rim 27 of wheel 19 is grasped by bail 25. The movement of sweep wire 41, 43 causes wheel 19 to rotate. Mooring tether T thus passes beyond the rear end of bail 25 and eventually out the opposite side of passthrough device 11.

Figure 16:
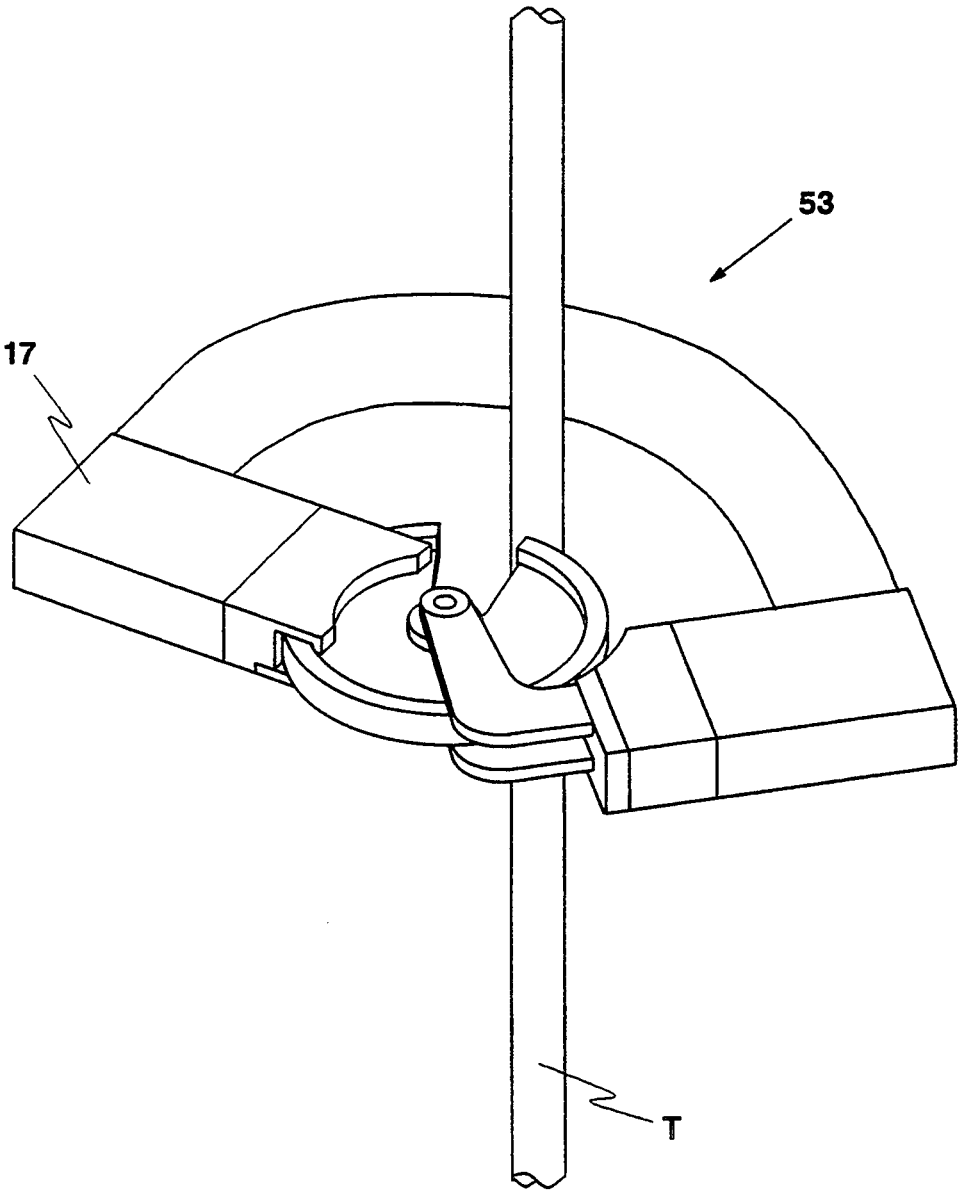

Before mooring tether T leaves passthrough device 11, it passes through smaller passthrough device 15, engages angled member 51, and pulls or pushes neutralization package 17 out of open clasp or holder 67. Clasp 67 controls release and initiation of neutralization package 17. Neutralization package 17 is released from clasp 67 by the movement of tether T through passthrough device 11. Pass through device 15 is a smaller version of passthrough device 11. However, while wheel 19 preferably can for example have one or two slots 29 and 31, smaller wheel 45 preferably has multiple slots like spokes on a star wheel. In mine countermeasure device 13, passthrough device 11 permits tether T to pass through sweep wire 41, 43, and passthrough device 15 permits tether T to enter neutralization package 17. When the mooring passes through into passthrough device 15, the mooring causes wheel 45 to rotate in a manner similar to the rotation of wheel 19 caused by the mooring and movement of sweep wire 41, 43. Rotation of wheel 45, like rotation of wheel 19, causes the mooring to pass through passthrough device 15. Mooring tether T then engages neutralization package 17 at member 51 and strips that package off of holder 67 and passthrough device 11. This causes release of float 53. Float 53 is then inflated. As shown in FIG. 16, float 53 when inflated has a fairly large opening or hole in it and has a fairly large radius of section. Calcareous or other growth (if any) fouling on the mooring T can thereby be overcome with the positive buoyancy of float 53. Float 53 inflates into a large fat shape with an enclosed interior opening, e.g. a toroid. Float 53 has a fairly large such interior hole in it because at least some of the explosive is located within the float. To accommodate the explosive, float 53 when inflated would be roughly circular in section with a fairly large radius. For example, the hole can be 8 inches to 9 inches in diameter, and the inflated toroid could have a cross-sectional radius or a radius in section of 2 inches to 2½ inches, so that float 53 presents an overall radius of for example 8 inches to 9½ inches. The configuration of float 51 should have a hole larger than the intended tether but smaller than the intended mine, and should have an overall radius greater than that of the intended mine.

Because float 53 moves along the mooring tether T, no moment is created in applying neutralization package 17 to mine M. This is because float 53 is provided with an interior hole and is released by tether T so that float 53 then goes up tether T. Once float 53 is stripped off pass-through device 11 by tether T, the float inflates and goes up tether T. Also, a moment can be avoided by placement of at least part of the explosives inside float 53. For example, if three one-pound charges of explosives are utilized in neutralization package 17, those charges can be placed in or on the package equidistantly (on equidistant centers) so that when float 53 is inflated, weight distribution on the float is symmetrical so that float 53 would rise up with a horizontal attitude.

Clevis surface 35 engaging wheel rim 27 is preferably coated with Teflon ® or a similar plastic material for a smooth, slippery surface. Teflon ® could also be used to coat the inside surface of wheel rim 27, and the portion of bail 25 contacting wheel 19.

One advantage of the arrangement of FIGS. 3 and 4 is that all explosions to neutralize mines take place after the sweep gear and the minesweeping vessel have moved away, thereby avoiding damage to the gear and the vessel.

Neutralization package 17 is illustrated in greater detail in FIGS. 6 and 7. As shown in FIG. 6, a large holder or spring clip 67 retains package 17 on bail 25. Holder 67 is fixed to bail 25. Package 17 includes two casings 69, 71 and therebetween an inflatable portion serving as float 53. As shown in FIG. 6, before deployment, float 53 is at least substantially collapsed and is folded over so that holder 67 can retain casings 69, 71. Casings 69, 71 are preferably rigid, but should be at least sufficiently firm that they can both be retained by holder 67 and can be removed from that holder by mooring tether T. One casing 71 is provided with a sea water switch 73 covered by a removable watertight seal 75. Switch 73 and seal 75 are also shown in FIG. 7. Seal 75 covers sea water switch 73 and provides a watertight seal to prevent premature closing of switch 73. .Switch 73 is closed (electric current passes therethrough) by the presence of sea water, which is electrically conductive. Seal 75 can for example be adhesively connected to cover switch 73. The construction of seal 75 can for example be similar to that of seal tabs for single-serving cans of fruit or vegetable juice such as Sacramento® tomato juice. Seal 75 has a loose tab portion 77 that is provided with a hole 79. Before deployment of neutralization package 17 from passthrough device 11, hole 79 engages a hook 81 fixed to and extending from bail 25. Hook 81 can for example be formed of No. 12 copper wire. With a sweep wire orientation such as that described above or in *U.S. Navy Mine Countermeasures Familiarizer*, neutralization package 17 will be pulled off holder 67 by tether T in an aft direction D at a 45 degree angle. When this happens, the movement of passthrough device 11 away from neutralization package 17 and tether T will cause hook 81 to pull seal 75 off sea water switch 73, causing electricity to be provided to the circuitry 83 of FIG. 7.

FIG. 7 illustrates the electric circuitry 83 of neutralization package 17. Closing of switch 73 by removal of seal 75 permits electricity to be provided to or from these components. Except for the explosive 99 disposed in float 53, each of these components is located in one or both of cases 69 and 71. Upon closing of switch 73, battery 85 provides electricity to the rest of electrical system 83 of neutralization package 17. Thus, a pinger in the form of acoustic transducer 87 then begins producing acoustic signals so that the mine can be located and destroyed if the neutralization package 17 fails to detonate. Closing of switch 73 also causes battery 85 to activate inflation system 89 and controller 91. Inflation system 89 causes release or production of gas such as from gas generator 93 connected to or disposed in float 53 to inflate float 53. Controller 91 provides an appropriate signal to throw arming relay 95. Relay 95 in turn activates firing switch 97 which, when closed, detonates explosives 99, 101 and 103. If desired, in order to provide sufficient time for float 53 to inflate and rise to at least the vicinity of mine M, a delay or timer 105 can be interposed between controller 91 and relay 95. If desired, neutralization package 17 can additionally be provided with a hydrophone 107 or a proximity switch 109. Such devices can be utilized to inform controller 91 whether float 53 is sufficiently close to mine M that detonation of explosives 99, 101 and 103 should neutralize mine M.

Before deployment of hardkill device 13, seal 75 must be applied to cover switch 73. Seal 75 is a sea water seal attached to switch 73 with adhesive and having an extension in the form of a pull tab 77. Switch 73 and seal 75 are located at one end of neutralization package 17. Pull tab 77 must be attached to hook 81 before deployment of countermeasure device 13. Switch 73 includes a cavity 111 in case 71 containing two electrical contacts 113, 115 of detonation system 83 of neutralization package 17. Seal 75 is a piece of tough flexible sheet (such as Mylar or metal foil) that is releasably secured in place over cavity 111 by attachment with an adhesive to the surrounding portion of case 71. Sea water completes an electrical circuit when the seal 75 over cavity 111 is broken. This completion can occur with only a slight perforation or lifting of seal 75 within the boundary of cavity 111. One example of this sort of seal is that used on small, single-serving size cans of fruit or vegetable juice such as Sacramento® tomato juice. However, other types of waterproof removable seals could be used instead.

With penetration or at least partial separation of seal 75 at cavity 111, sea water enters cavity 111. The sea water thus entering cavity 111 completes an electrical circuit that activates inflation system 89, acoustic marker 87 and controller 91. Controller 91 controls arming and detonation of explosives 99, 101 and 103 to neutralize mine M. Inflation system 89 is preferably a gas generator like that used in automobile crash bags, also commonly referred to as air bags. Inflation system 89 for that situation ignites a pyrotechnical charge 93 that produces gas which inflates float 53. However, other methods could be used to inflate float 53, such as the release of gas stored under pressure. For example, a squib could be used to open a small bottle of high pressure gas. For this purpose, a small bottle of pressurized carbon dioxide, such as is used in life jackets, could be used for this purpose. Acoustic pinger 87 is also activated by closing of switch 73 and emits pulses according to its preset frequency. Pinger 87 could instead emit a radio signal, or could emit a signal other than a series of pulses.

To detonate explosives 99, 101 and 103, it is preferred to use an acoustic system including hydrophone 107 connected to controller 91. When hydrophone 107 receives appropriate acoustic signals from the minesweeper other sweep craft, controller 91 in response first throws arming relay 95 to arm explosives 99,101 and 103, and then activates firing switch 97 to detonate those explosives. A proximity switch 109 could be used instead of or with hydrophone 107. Timing circuit 105 provides the option of delayed remote detonation. Timer 105 can also permit sterilization (deactivation) of the neutralization package if desired, by breaking the electrical path to relay 95 after a sufficiently long period of time has elapsed. If desired, the battery can be shorted out after a preset duration using timer 117 as an additional sterilization measure.

Figure 8:
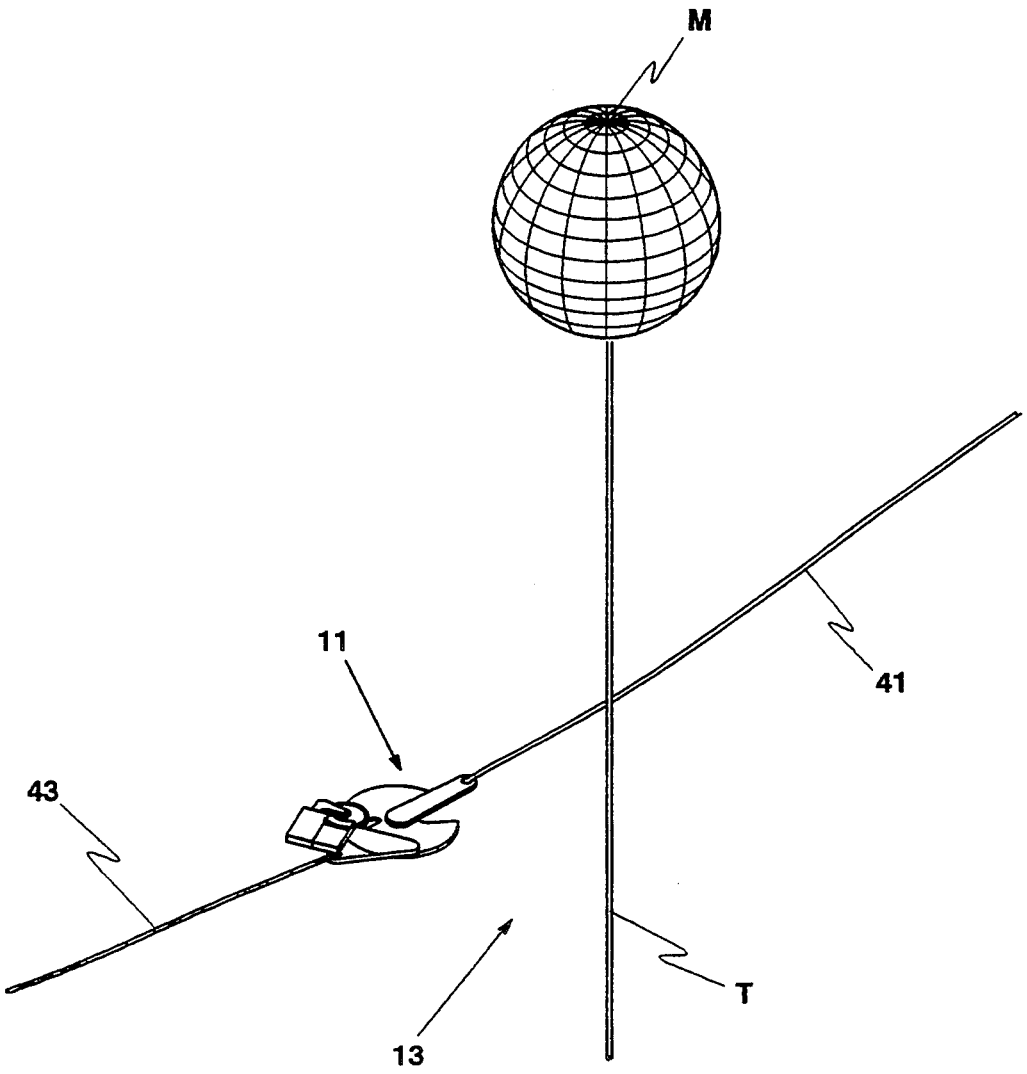
FIGS. 8–18 together illustrate one form of operation of the device of FIGS. 1 and 2, shown in various successive stages of operation.
Figure 9:
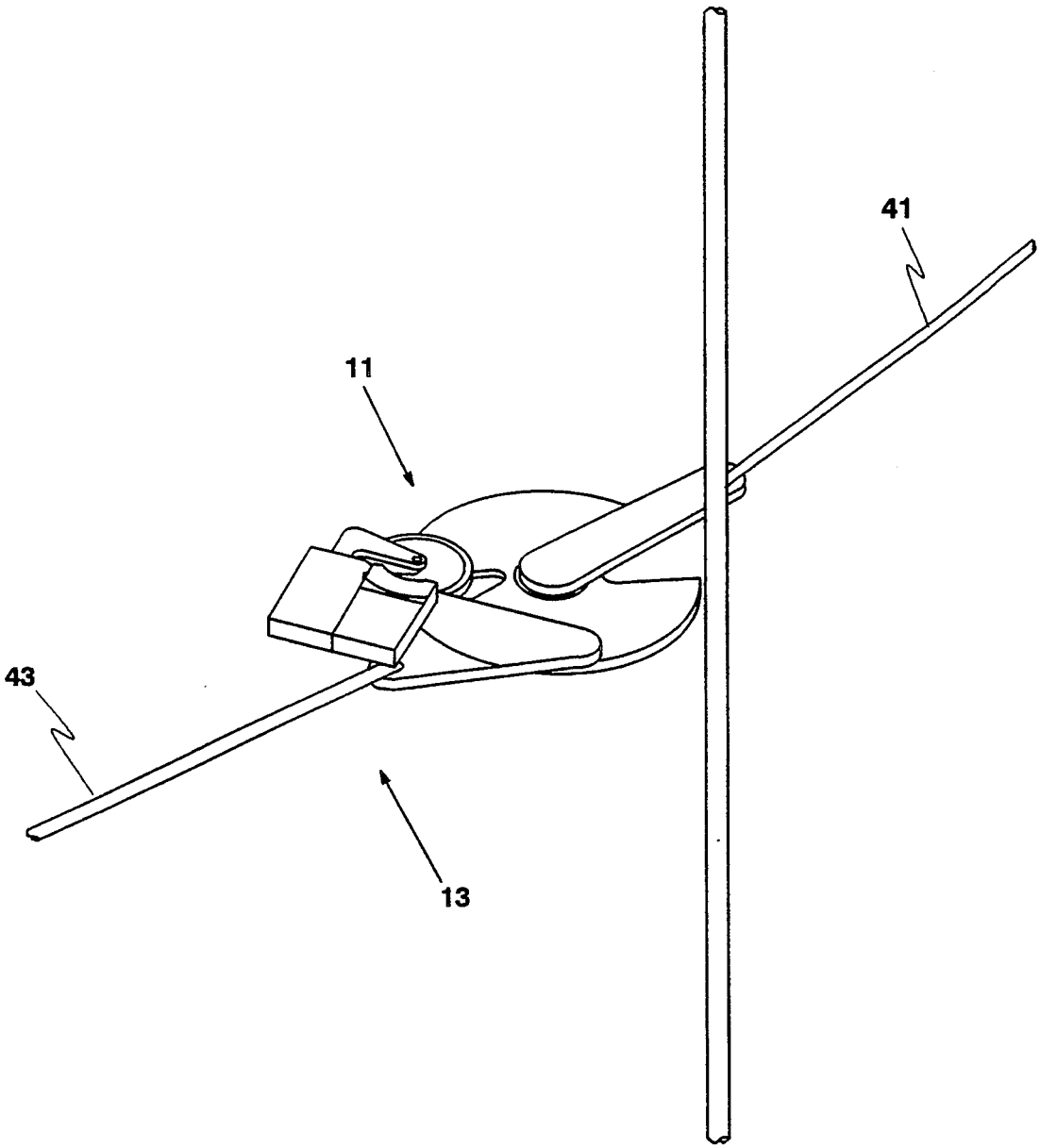
Figure 10:
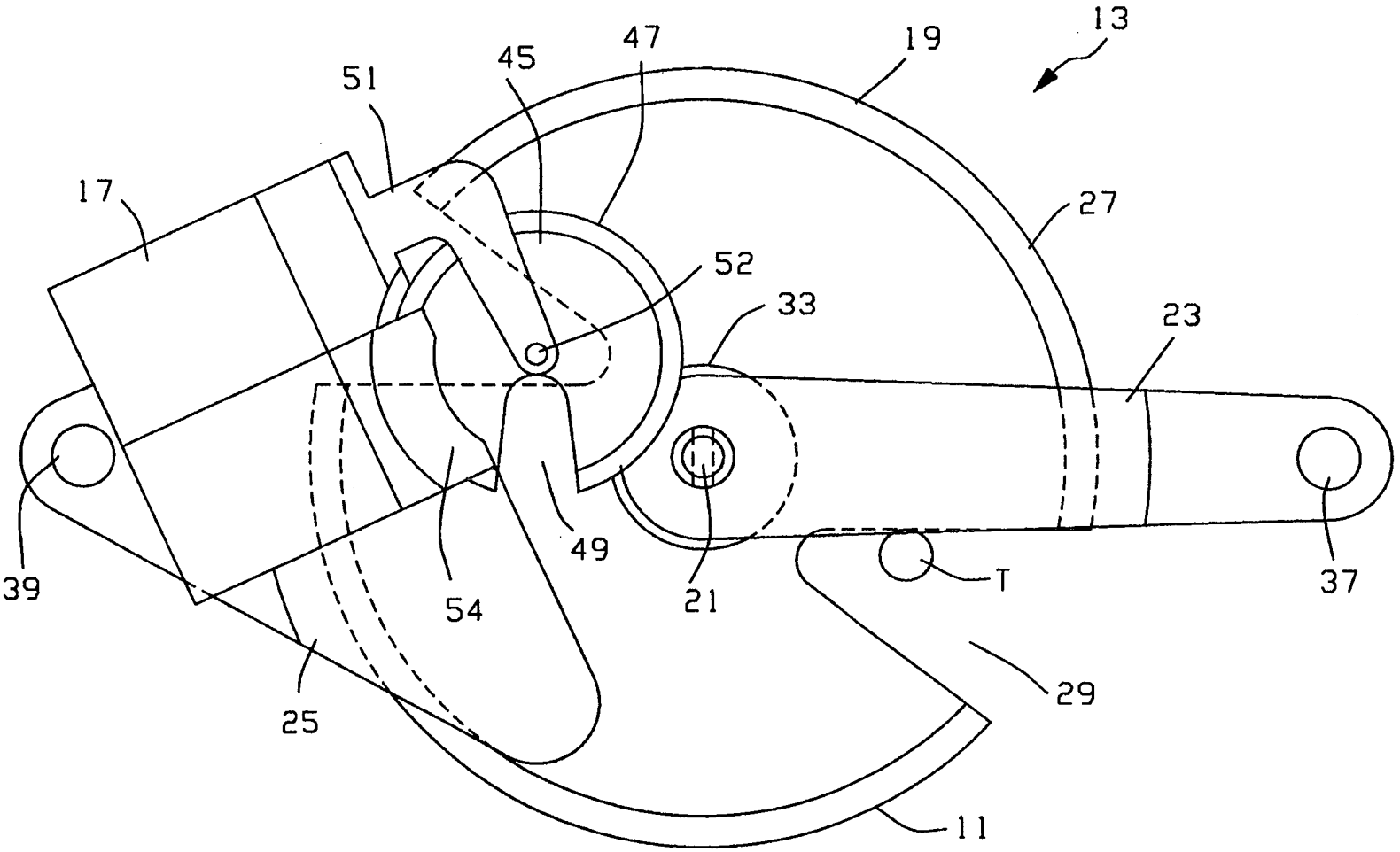
Figure 11:
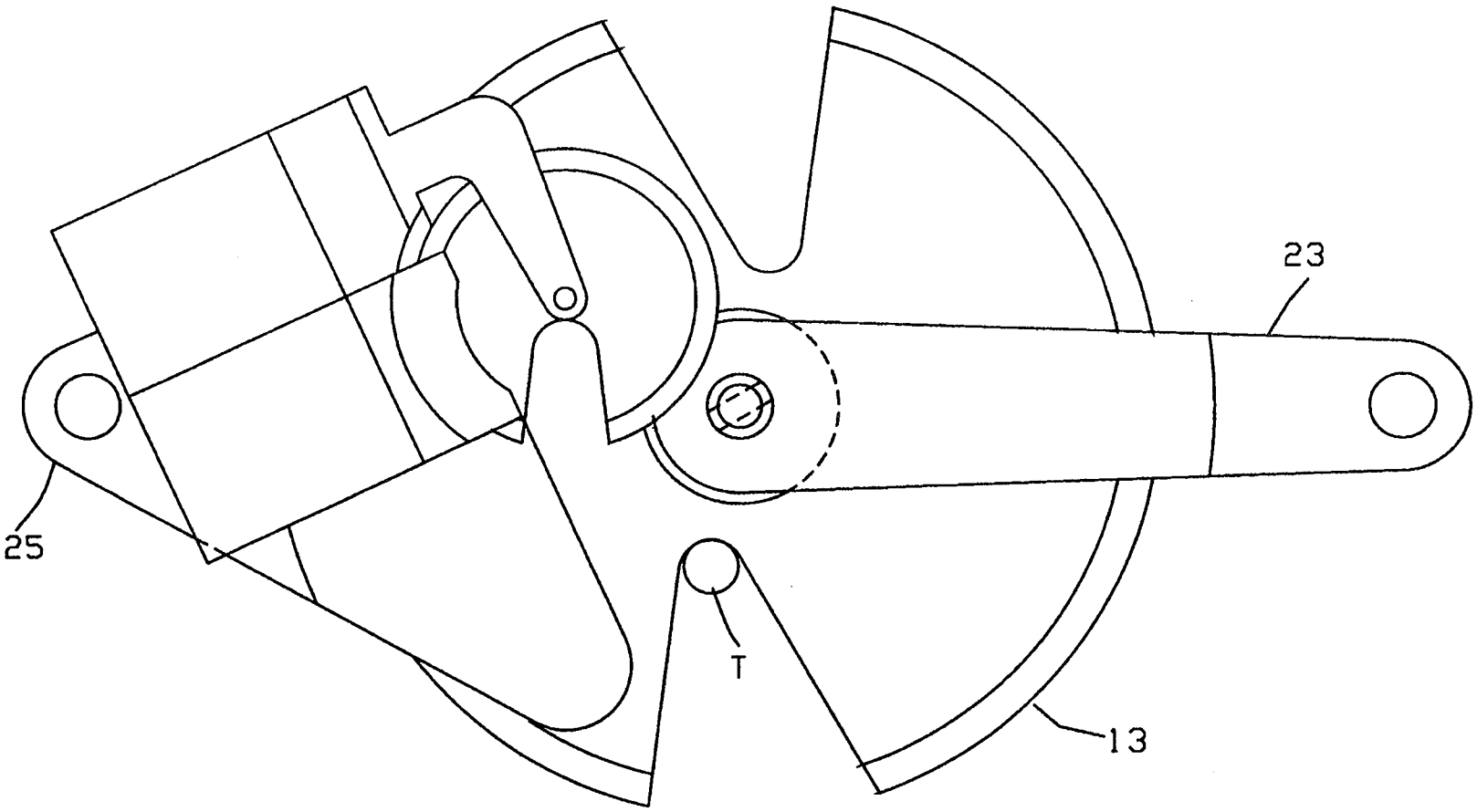
Figure 12:
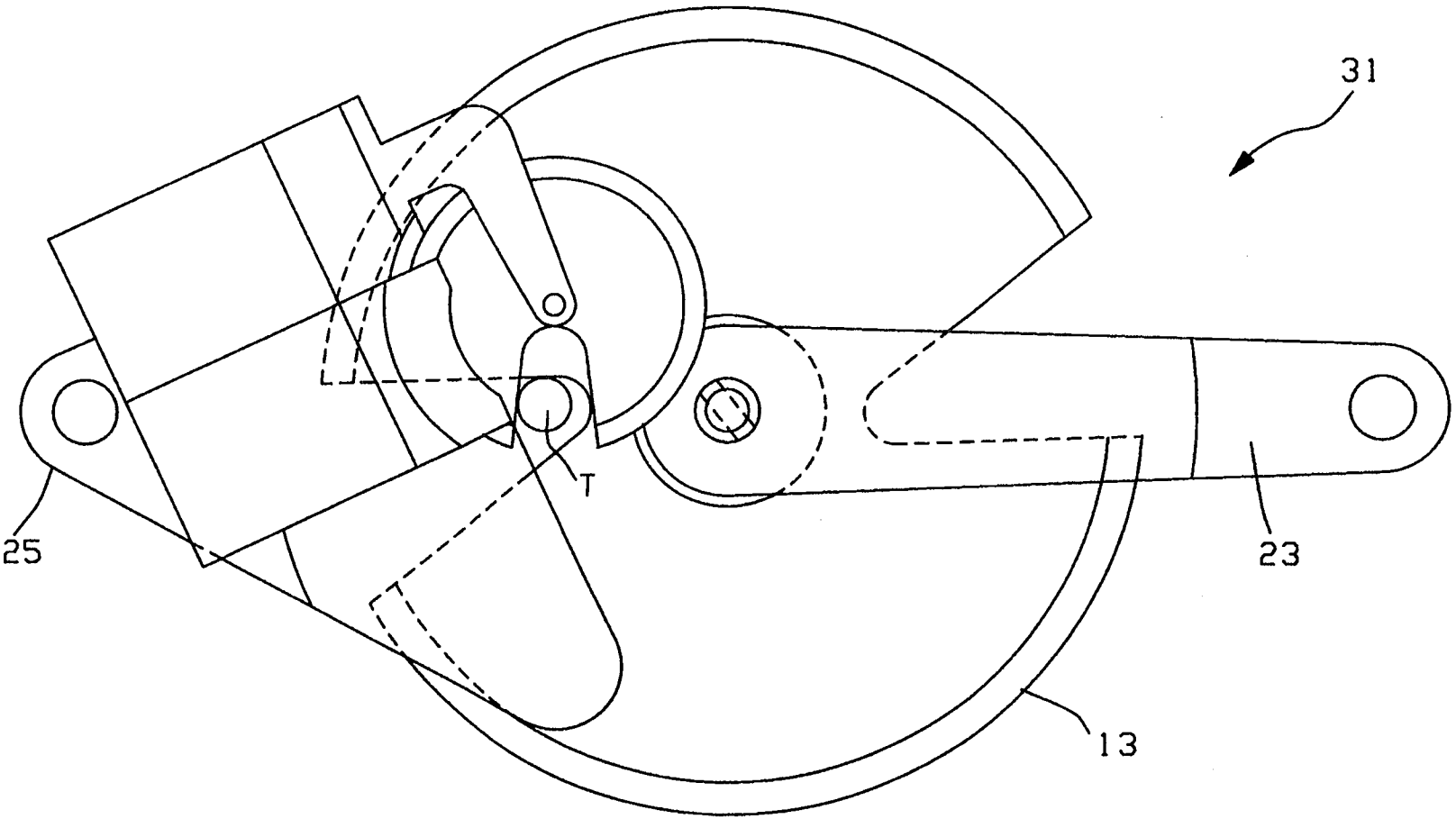
Figure 13:
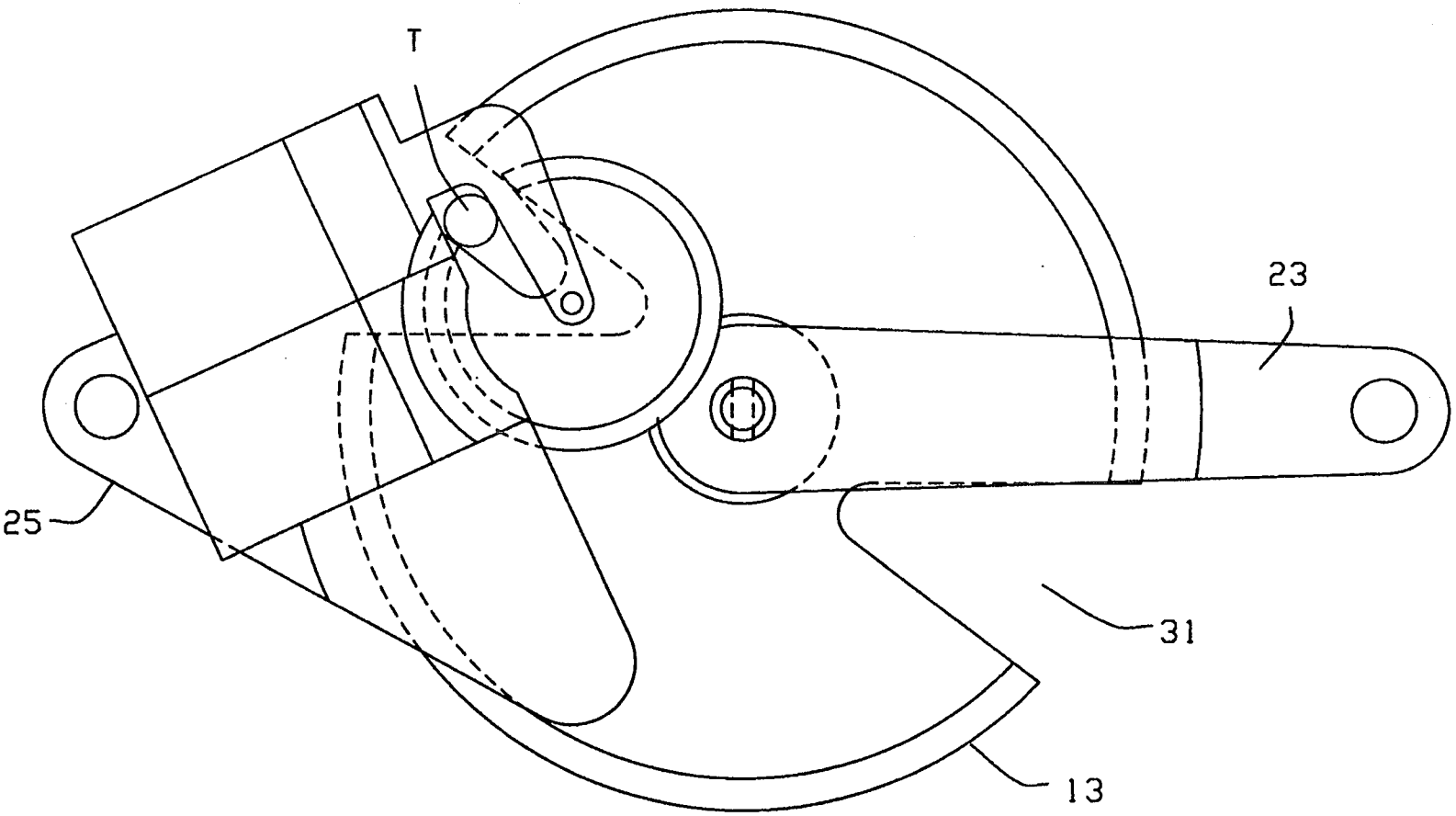
Figure 14:
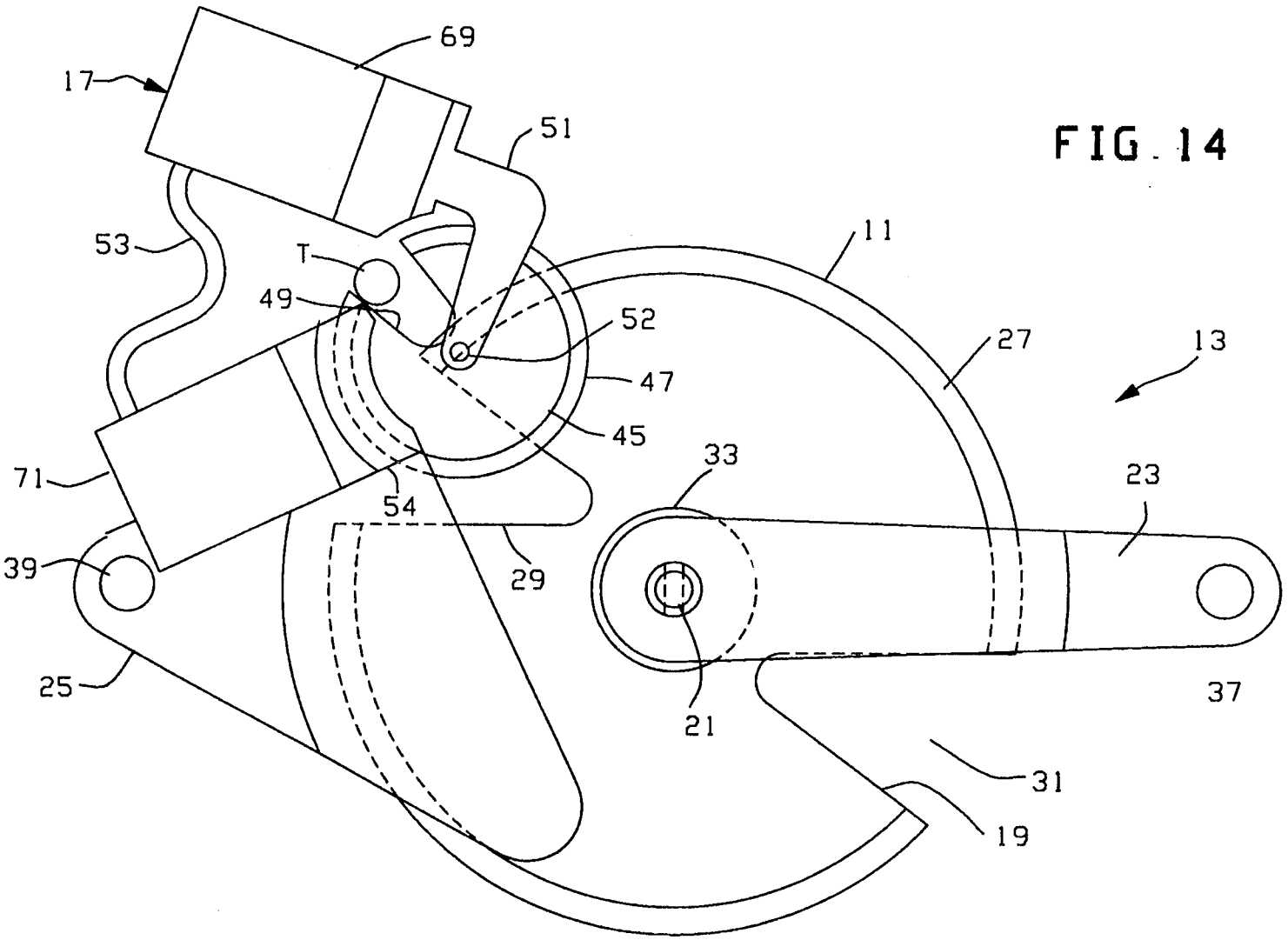
Figure 15:
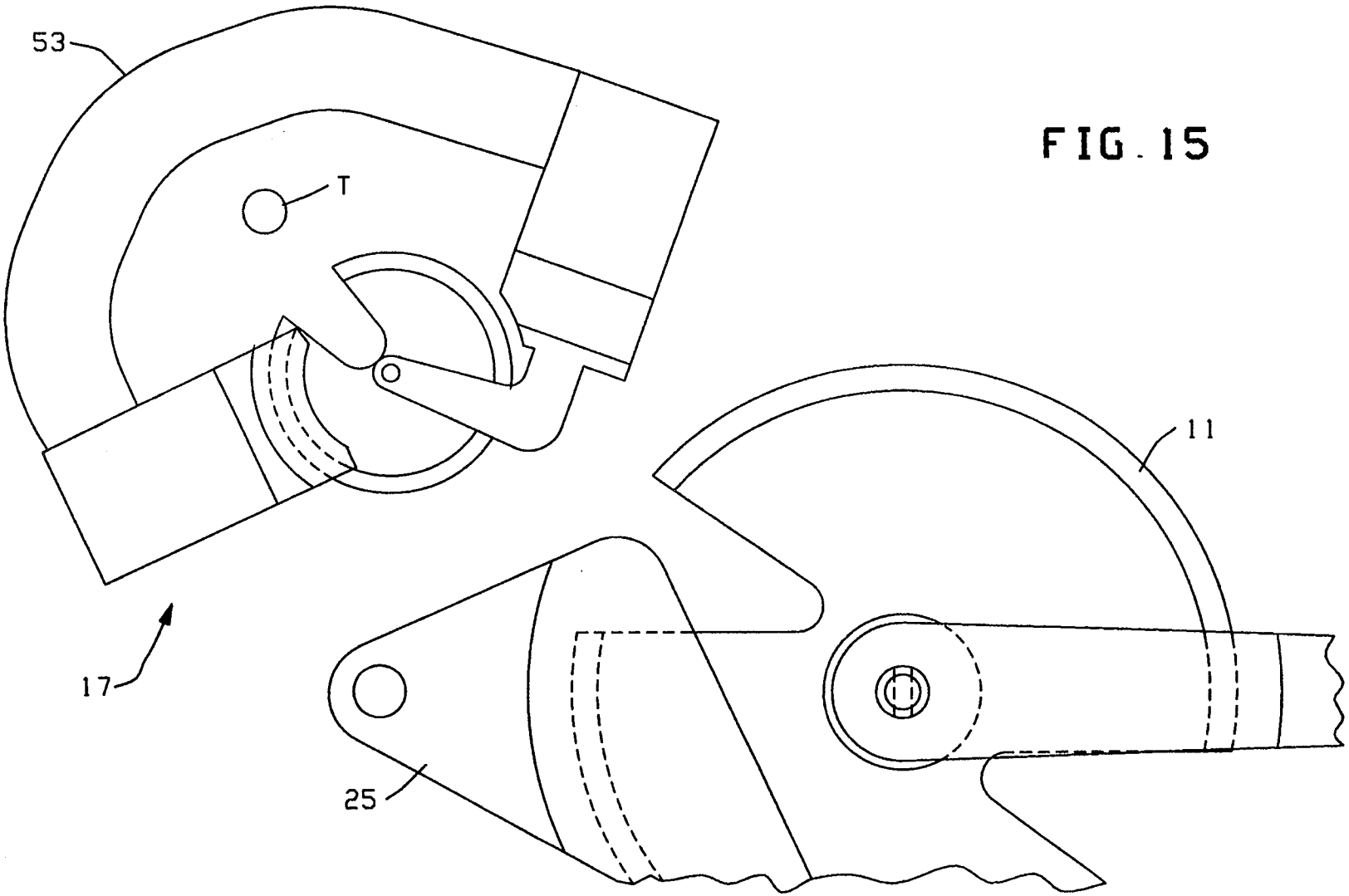
Figure 17:
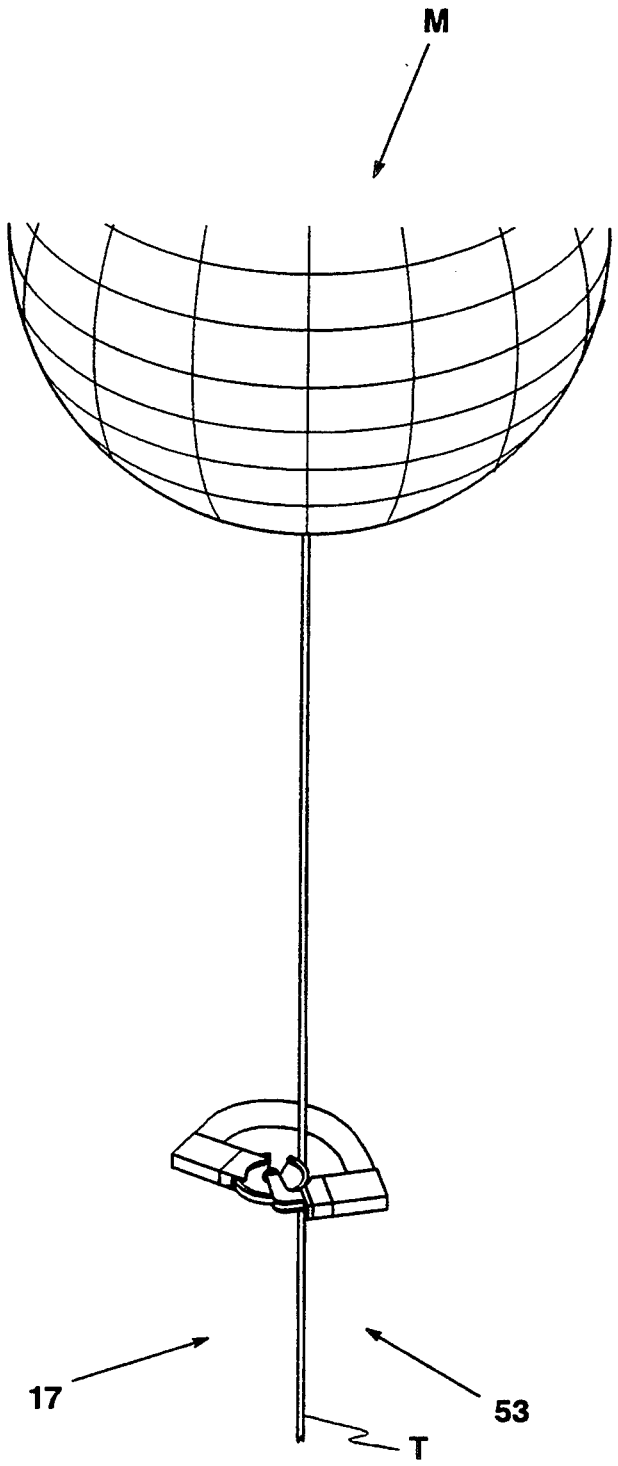
Figure 18:
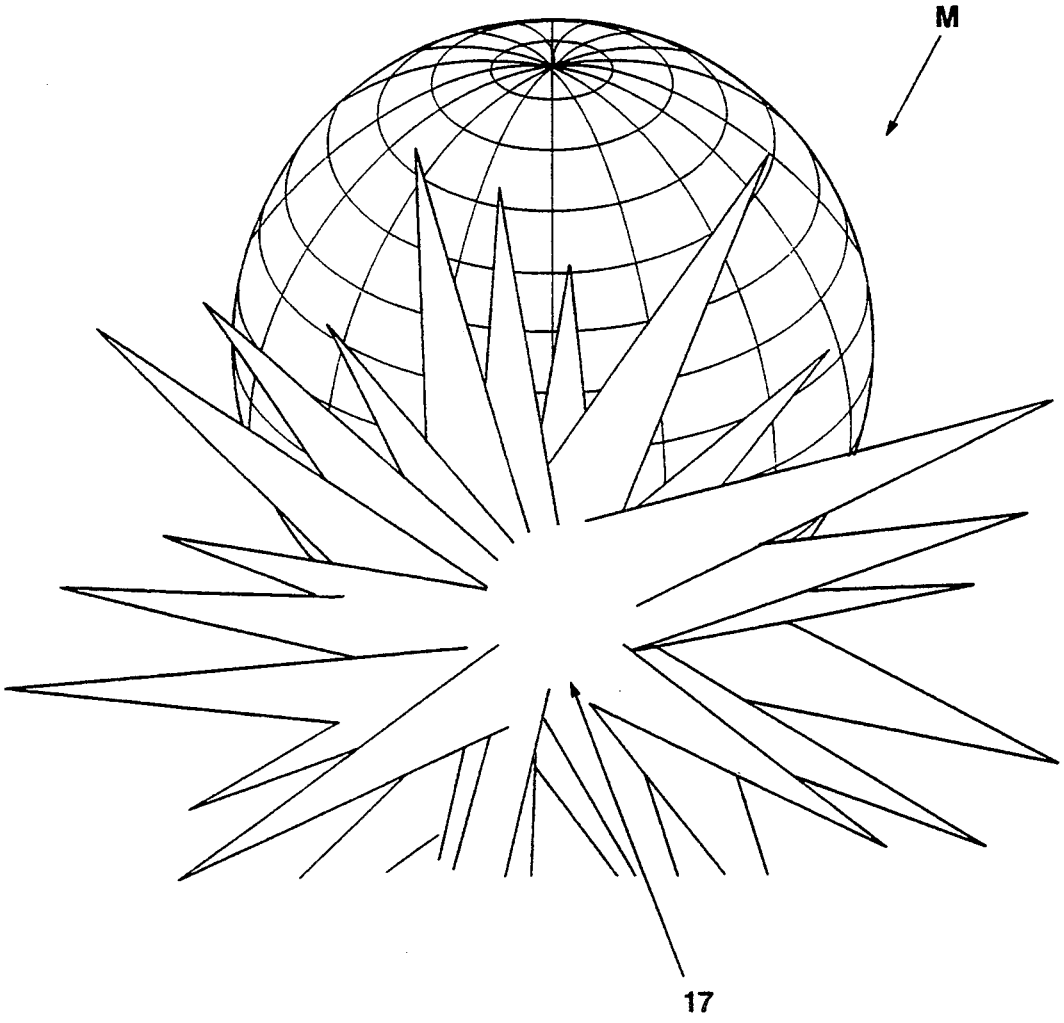

FIGS. 8–18 together illustrate one form of operation of the device of FIGS. 3 and 4 by showing that device in various successive stages of operation. In FIG. 8, hardkill device 11 on sweep wire 41, 43 approaches tether T of moored mine M. Sweep wire 41 could then be contacting and sliding past tether T. In FIG. 9, hardkill device 11 is about to engage that tether T at the open end 68 of slot 29. In FIG. 10, tether T enters passthrough device 11 at slot 29. Forward movement of passthrough device 11 causes tether T to move towards apex 65 of slot 29. In FIG. 11, tether T is lodged at apex 65. Because passthrough device 11 continues to move forward, and because apex 65 is displaced from hub 33, a force moment is created between tether T and axle 21 which causes wheel 19 to rotate, thus carrying tether T rearwards. As shown in this figure, tether T moves into the gap between clevis 23 and bail 25, and would completely pass device 11 if not for the presence of wheel 45. In FIG. 12, continued forward movement of hard-kill device 13 causes tether T to enter slot 49 of wheel 45. Tether T remains in slot 29. In FIG. 13, continued forward movement of pass-through device 11 due to movement of sweep wire 41, 43 causes wheel 45 to rotate to a position where the open end of slot 49 faces substantially opposite the direction of movement of passthrough device 11, enabling tether T to escape from slot 49, slot 29, and pass-through device 11 and be captured by and engage neutralization package 17. Rotation of wheel 45 can if desired also be restricted to provide further assurance that the mooring remains captured by neutralization package 17. Wheel 45 thus permits tether T to be encompassed by neutralization package 17.The mooring T can now remove the neutralization package from pass-through device 11. In FIG. 14, continued forward movement of pass-through device 11 causes tether T to strip neutralization package 17 off holder 67, taking wheel 45 with it. In FIG. 15, neutralization package 17 and wheel 45 move away from pass-through device 13, and float 53 begins to inflate. In FIG. 16, fully inflated float 53 is disposed about tether T. In FIG. 17, inflated float 53 rises along tether T towards mine M, carrying the rest of neutralization package 17 and wheel 45 with it. In FIG. 18, neutralization package 17 detonates just below mine M, thereby neutralizing the mine.

Figure 19:
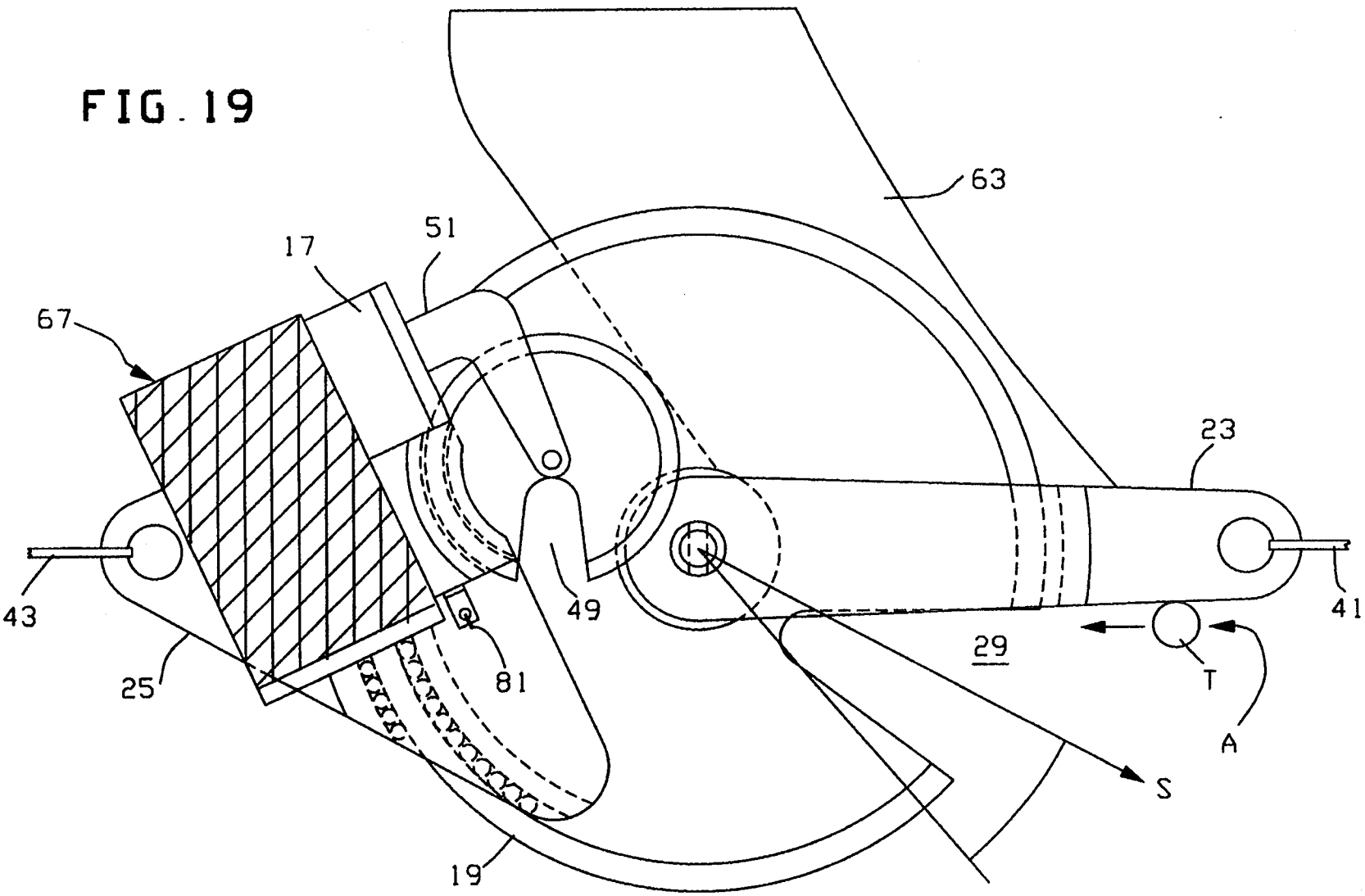
FIGS. 19–24 together illustrate one sequence of operation of the device of FIGS. 3 and 4.
Figure 20:
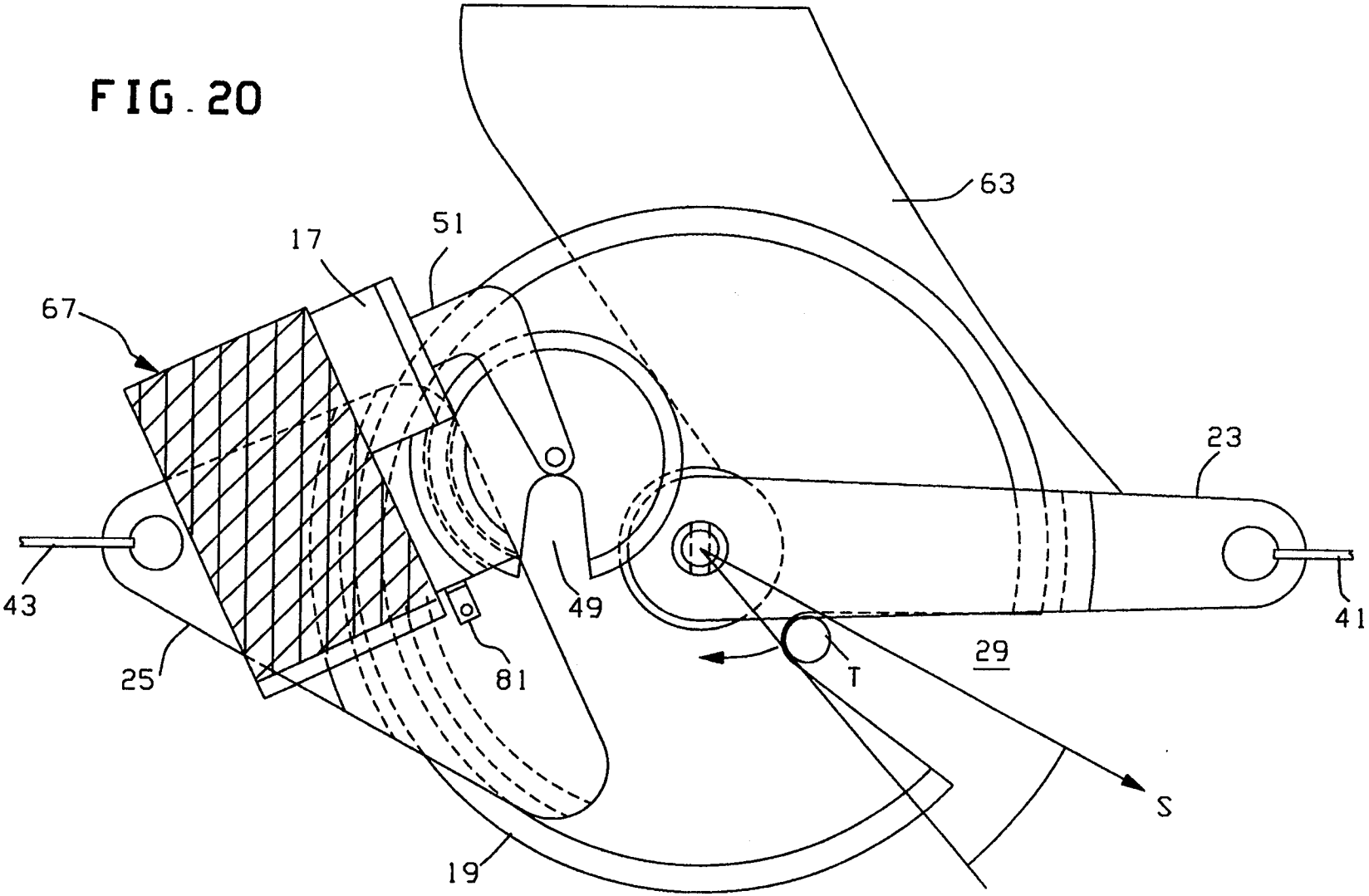
Figure 21:
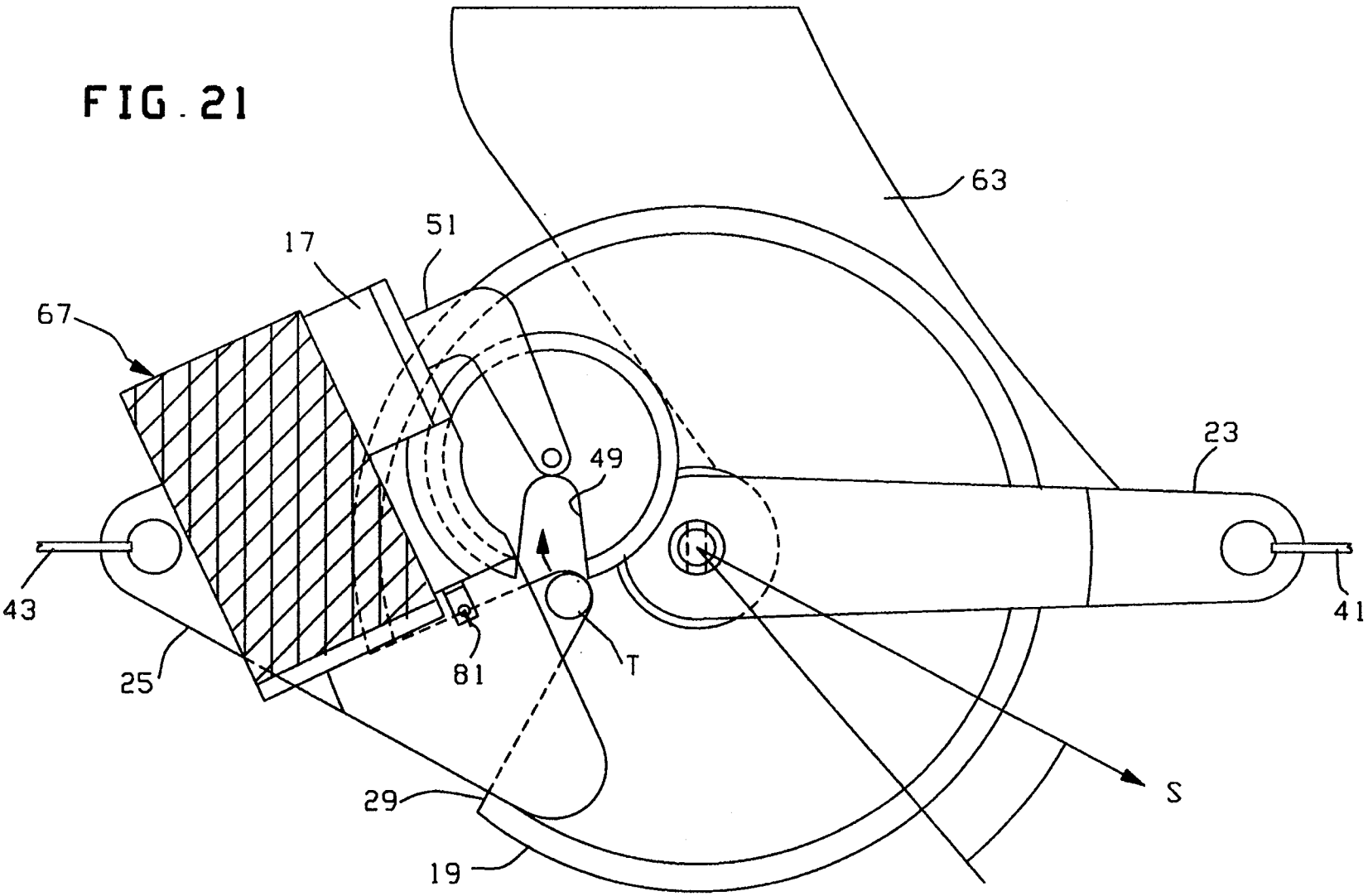
Figure 22:
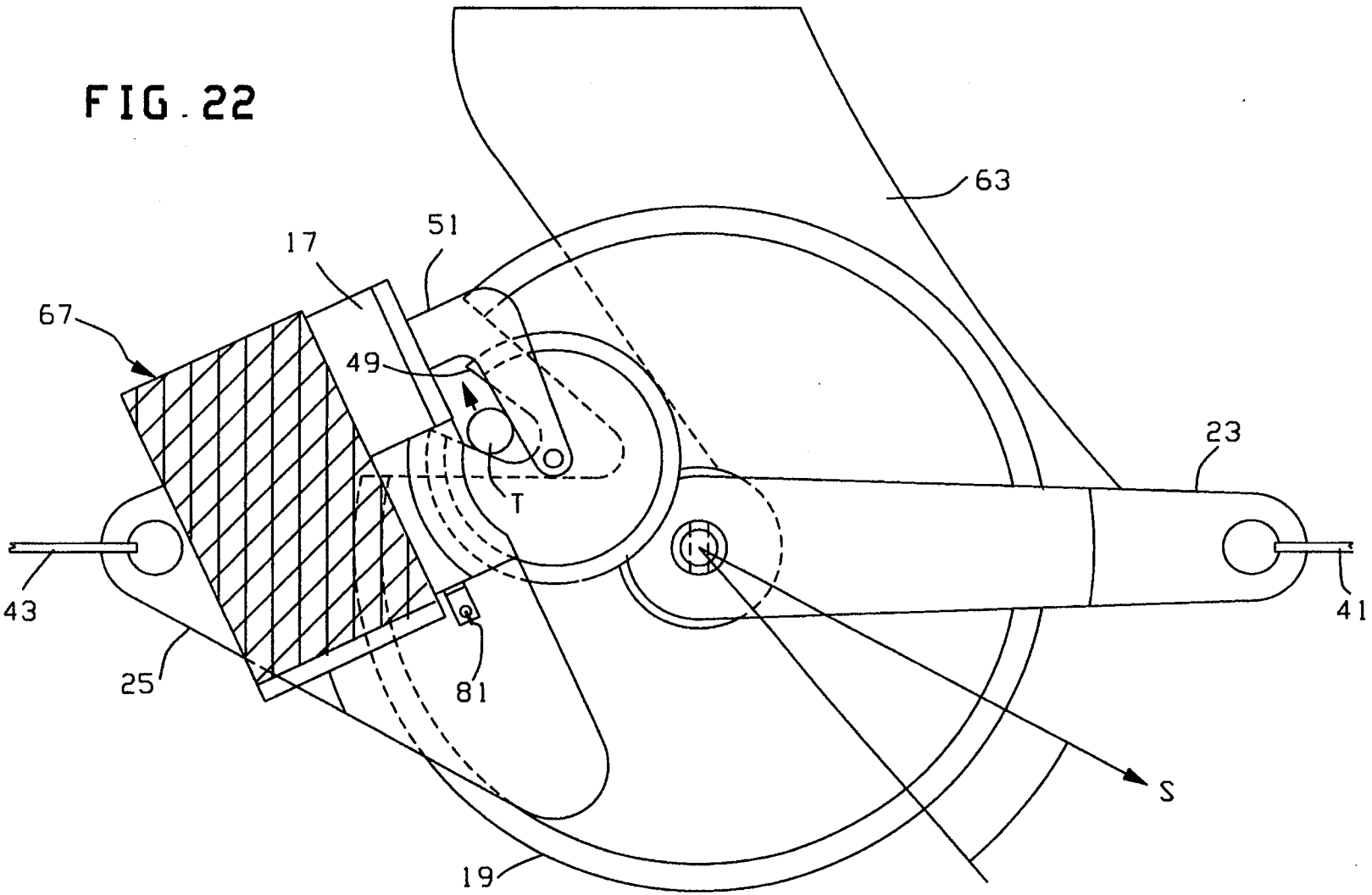
Figure 23:
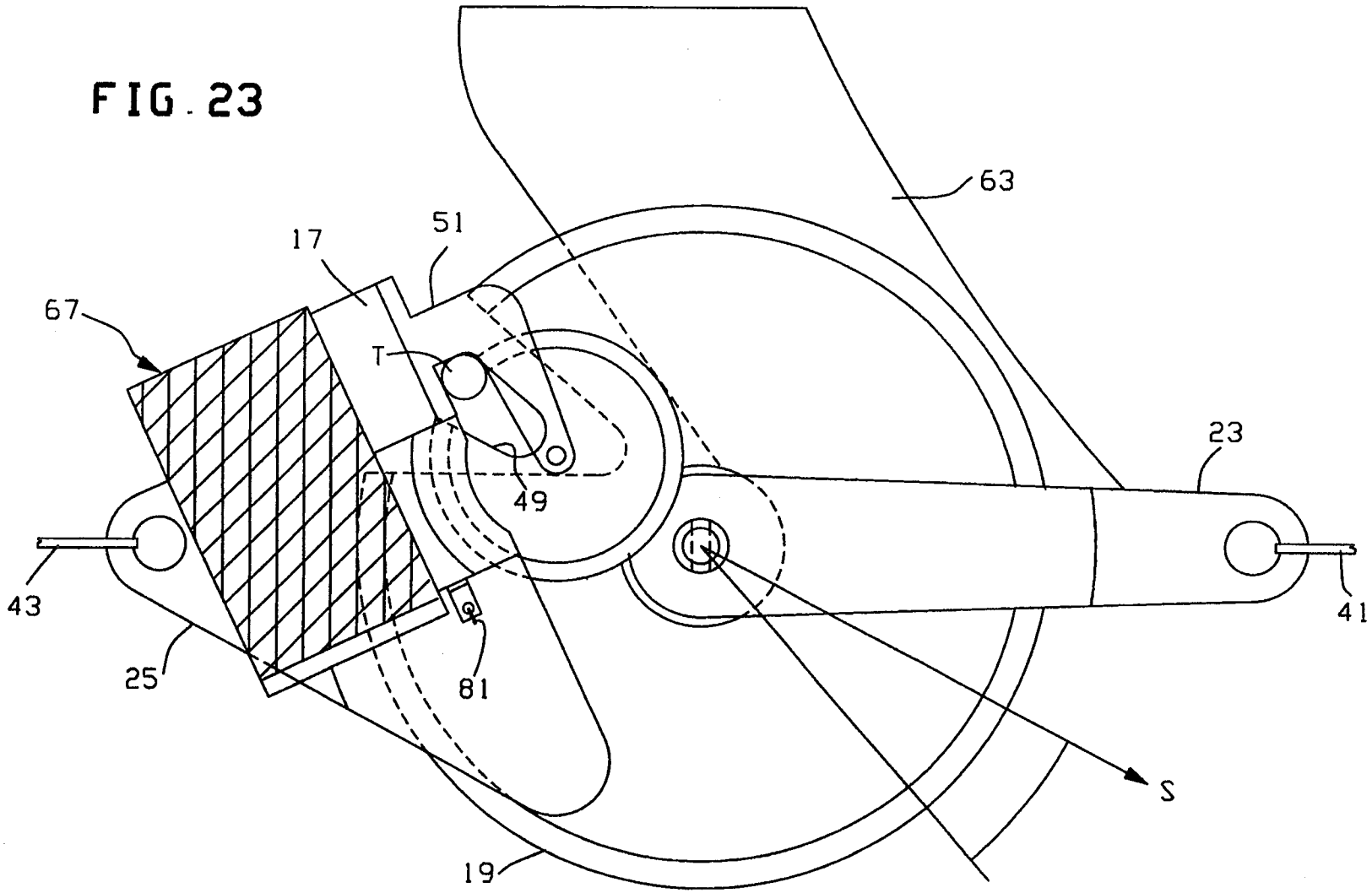
Figure 24:
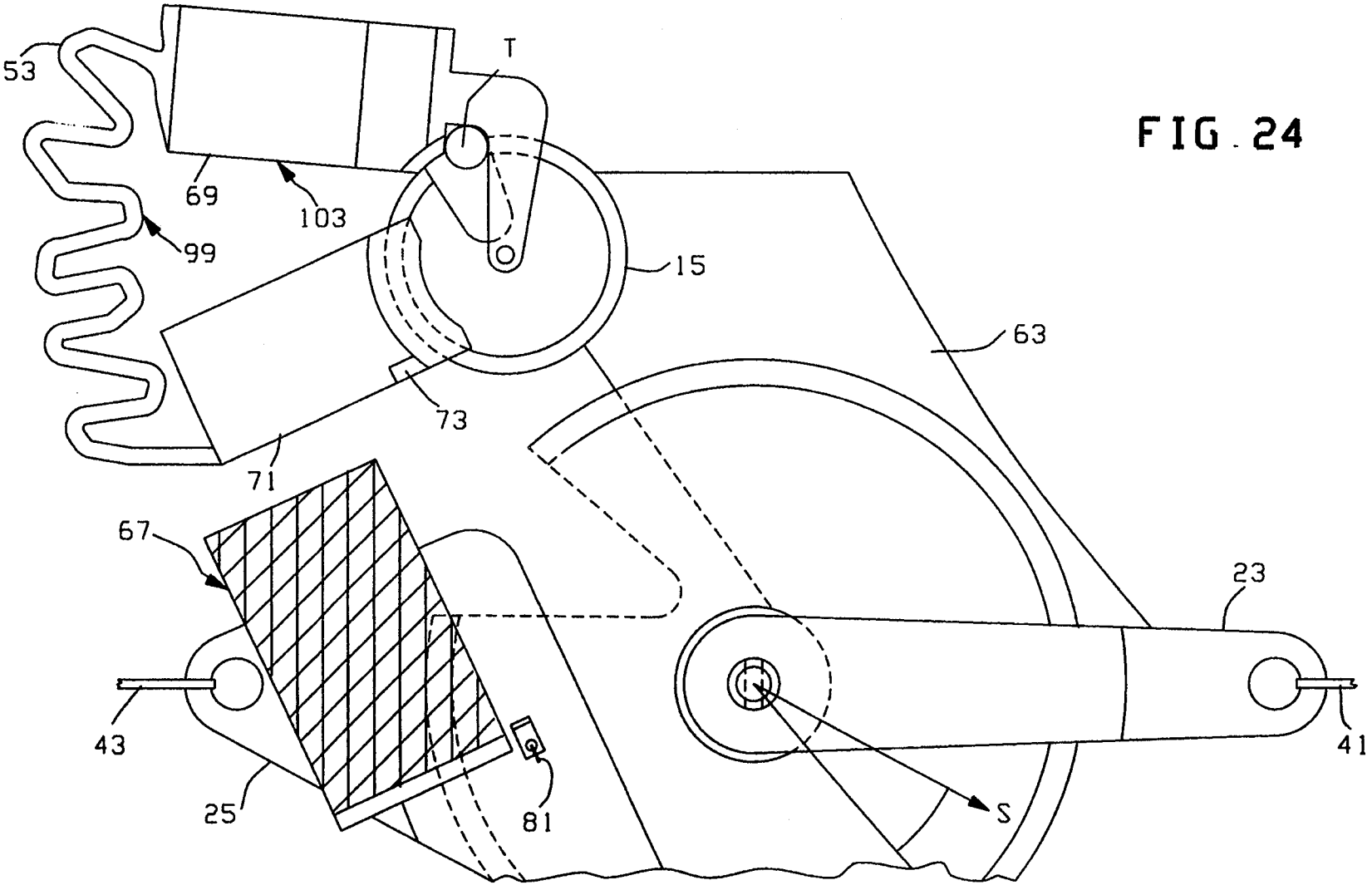

The sequence of operation of FIGS. 8–18 is also illustrated in FIGS. 19–24. In FIG. 19, the sweep travels in direction S, and slot 29 is approaching tether T which has apparent motion A as the sweep wire moves against it. In FIG. 20, tether T is at apex 65. In FIG. 21, tether T causes slot 29 and wheel 19 to rotate, and tether T is about to enter slot 49. In FIG. 22, tether T causes wheel 45 to rotate about 120 degrees. In FIG. 23, tether T moves from the apex of slot 49 to engage right-angled member 51 and begin to pull neutralization package 17 off holder 67. Holder 67 is open at at its back side so that neutralization package 17 can be removed from the holder. In FIG. 24, mooring tether T is captured by neutralization package 17 and engages member 51 to pull the neutralization package out of holder 67 and away from passthrough device 11 because sweep wire 41, 43 is moving and the mooring is stationary. Seal 75 is torn loose from cavity 111 by hook 81, and sea water contacts exposed contacts 113, 115 to close switch 73.

Figure 25:
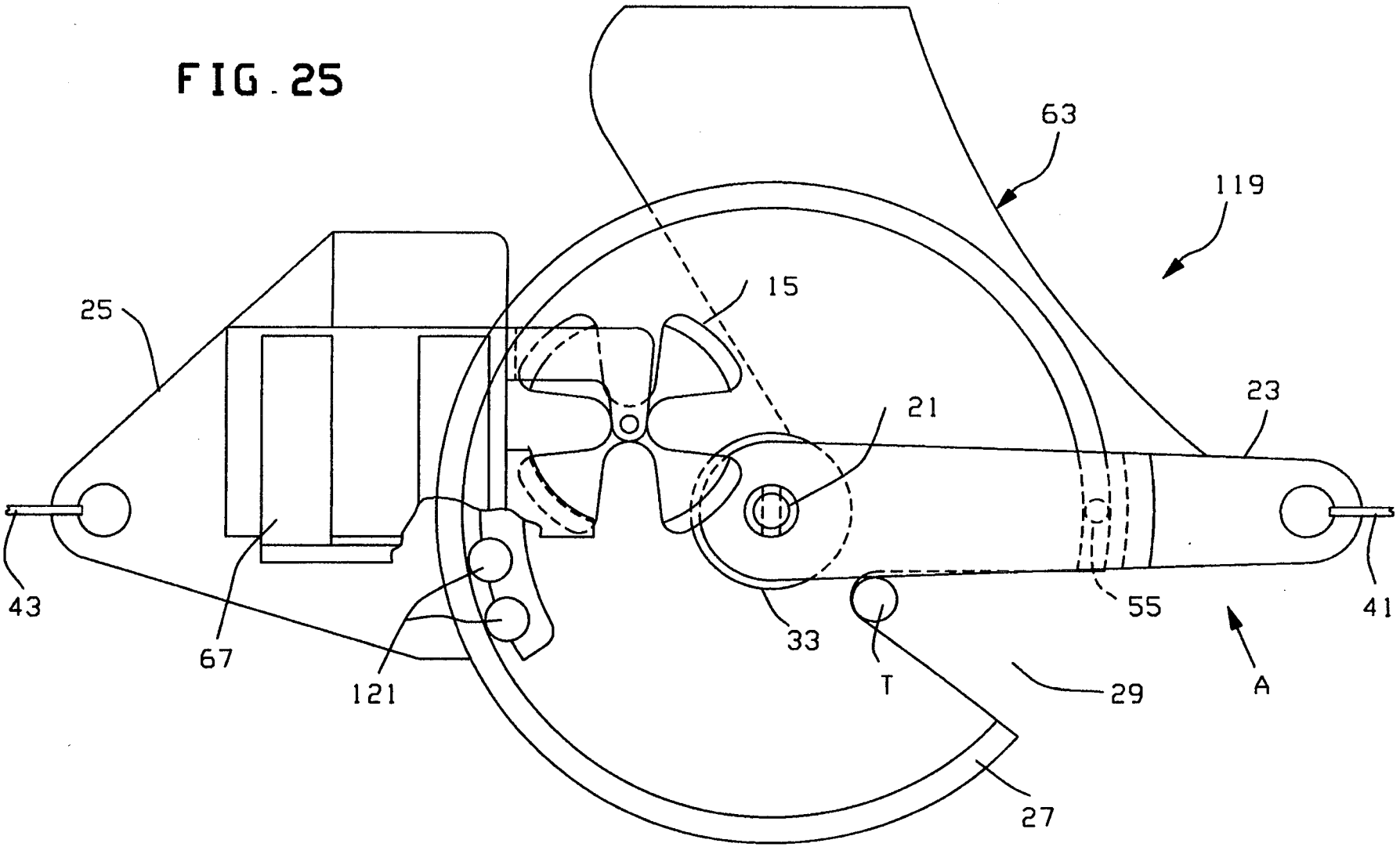
FIG. 25 is a plan view of another embodiment of a moored mine countermeasure device according to the present invention.
Figure 26:
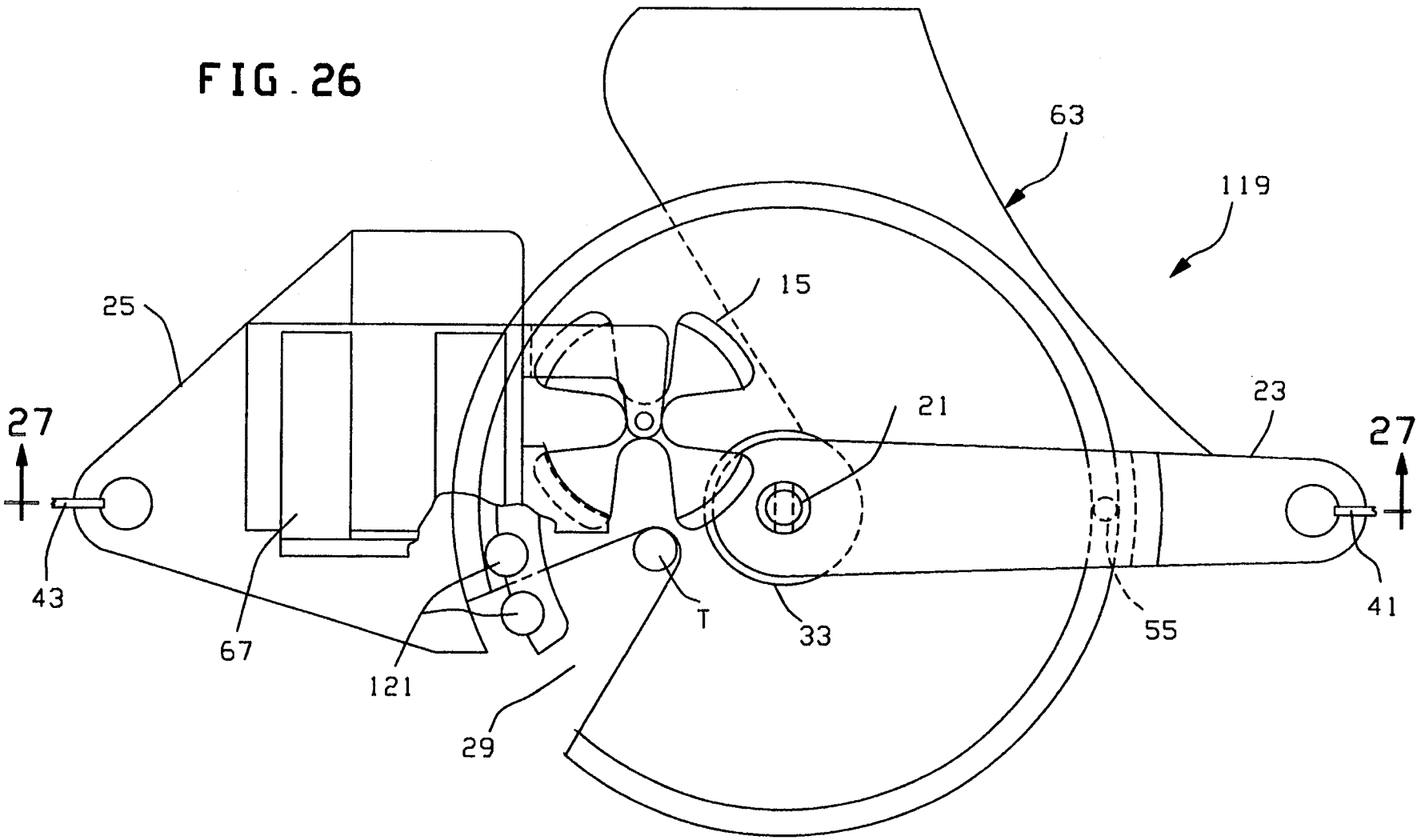
FIG. 26 shows the device of FIG. 25 in another stage of operation.
Figure 27:
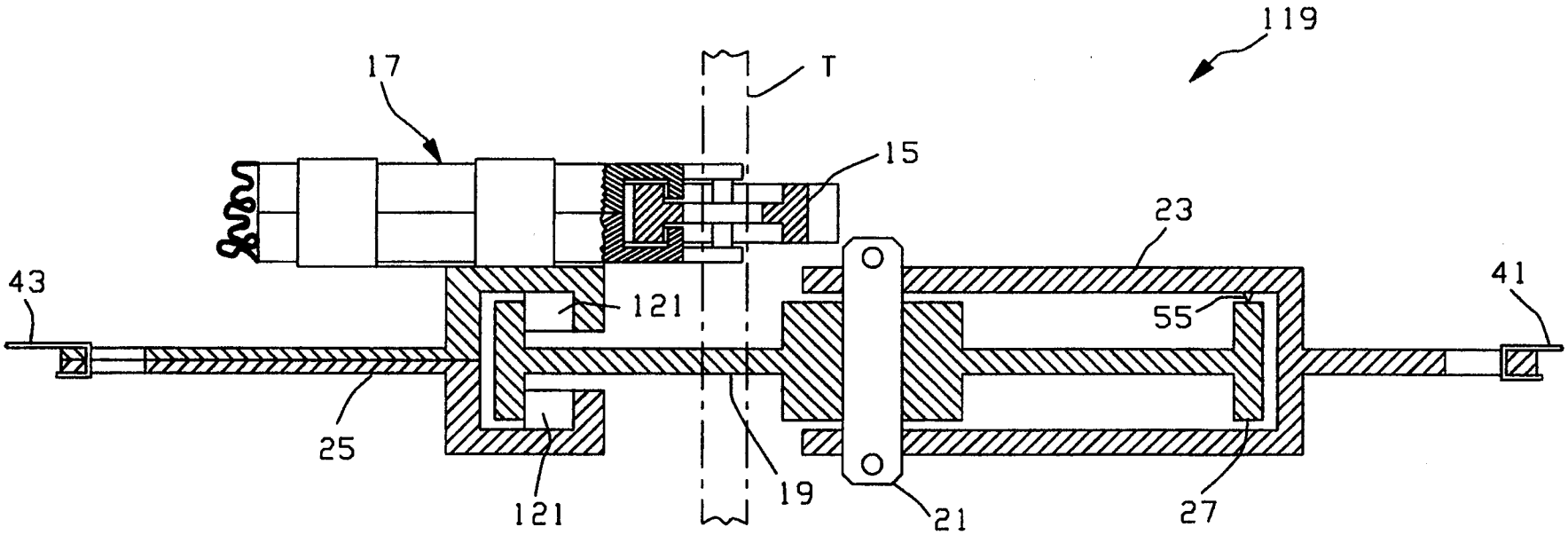
FIG. 27 is a section of the device of FIGS. 25 and 26 taken along the line 27—27 of FIG. 26.
Figure 28:
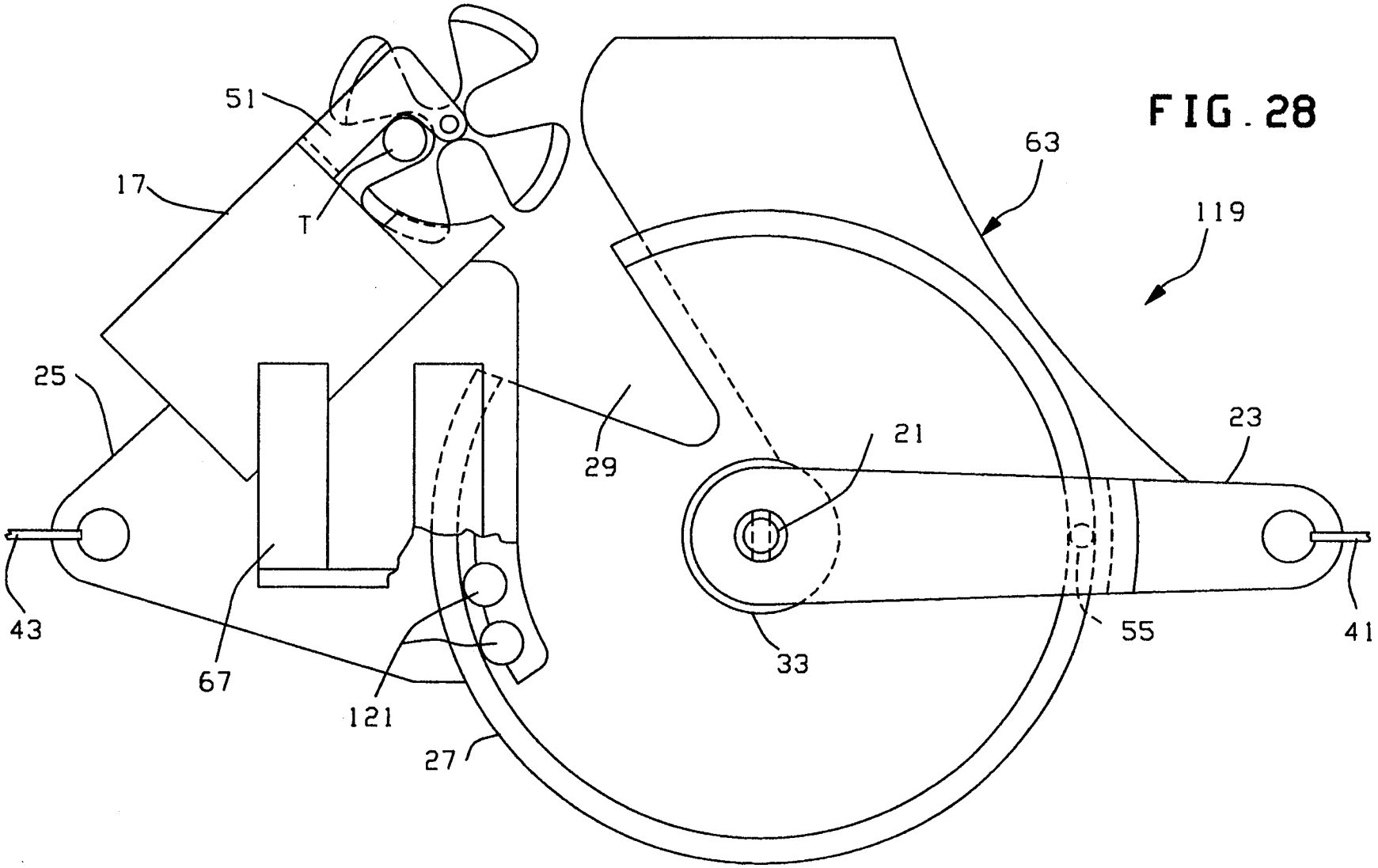
FIG. 28 is a plan view of the device of FIGS. 25–27 in still another stage of operation.

FIGS. 25–28 illustrate another alternative embodiment of a moored mine countermeasure device 119 according to the present invention. This embodiment differs from that of FIGS. 3 and 4, and from that of FIG. 5, in that the Teflon® coating at surface 35 has been replaced with captured anti-friction rollers 121 held in bail 25 and contacting wheel rim 27. In FIG. 25, the mooring is at the apex 65 of slot 29. In FIGS. 26 and 27, tether T is about to enter wheel 45. In FIG. 28, the mooring passes passthrough device 11 and sweep wire 41, 43, and removes neutralization package 17 from passthrough device 11. Except for the inclusion of rollers 121, operation of this embodiment of countermeasure device 119 is identical to that of countermeasure device 13.

Figure 29:
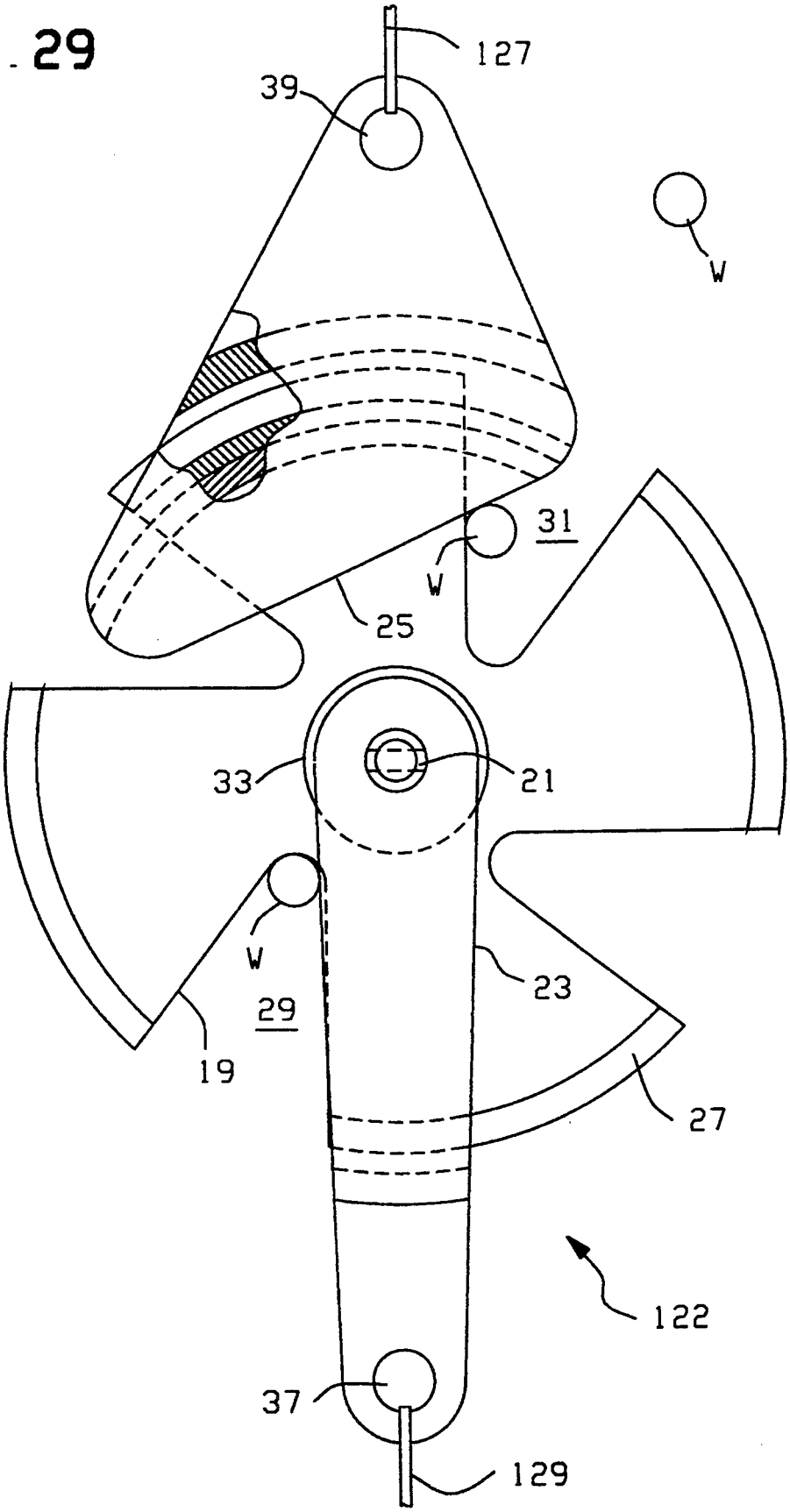
FIG. 29 illustrates one embodiment of a moored mine sweep countermeasure device according to the present invention.

FIG. 29 illustrates a minesweep countermeasure device 122 according to still another embodiment of the present invention. FIG. 29 shows a variation of the present invention wherein a pass-through mechanism like that of FIGS. 1 and 2 is used as an anti-sweep device in the mooring 127, 129 of a mine of friendly forces to prevent sweeping by unfriendly forces. The pass-through mechanism can be used as an anti-sweep device in the mooring of a moored mine owned by friendly forces to prevent sweeping by an enemy. It would be preferred that wheel 19 have as many slots as would be physically and structurally possible, and that the entire mechanism be made of a copper-bearing material (such as beryllium copper) possessing anti-fouling properties. This device, as well as pass-through device 13 and pass-through device 119, could be used on friendly mines to make them resistant to being swept. The orientation of the pass-through device would then be vertical in the mooring instead of horizontal, subject to movement by currents and the like.

Figure 30:
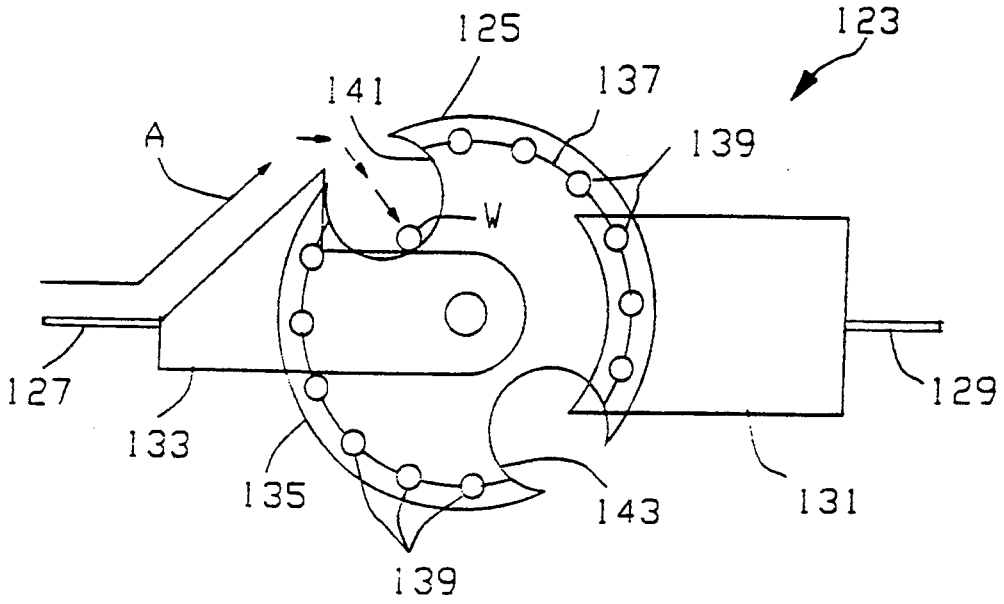
FIG. 30 illustrates another embodiment of a moored minesweep countermeasure device according to the present invention.
Figure 31:
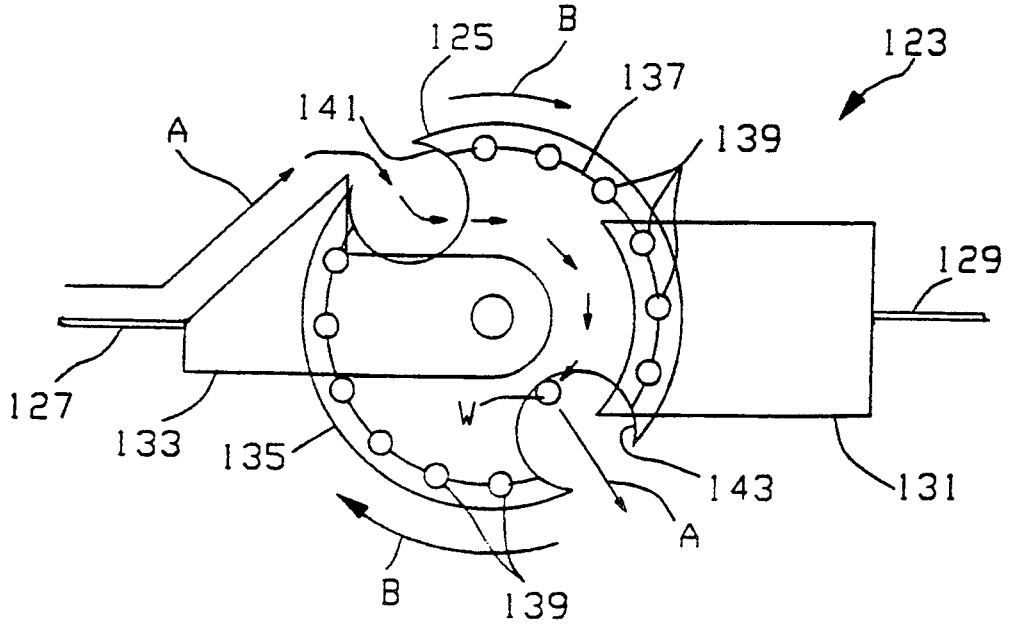
FIG. 31 illustrates the device of FIG. 30 in another stage of operation.

FIGS. 30 and 31 illustrate a minesweep countermeasure device 123 according to yet another embodiment of the present invention. Devices 122 and 123 each make moored mines, sown by friendly forces, resistant to being swept. FIG. 30 shows a pass-through device 125 attached to mooring cable 127, 129 of a "friendly" mine to prevent its being swept. Although FIG. 30 does not so show, bail 131 and clevis 133 of device 125 are disposed on both sides of double-slotted wheel 135. Bail 131 engages the T-shaped rim 137 of wheel 135 via a plurality of rollers 139. This passthrough device 123 would be positioned vertically on the mooring cable 127, 129 at a depth at which a sweep wire W would be expected to appear. Should a wheel slot 141 or 143 engage a sweep wire W, wheel 135 would be rotated by movement of the sweep wire substantially 180 degrees, permitting the sweep wire to pass between bail 131 and clevis 133 without engaging the mooring cable 127, 129. For this pass-through configuration, a neutralization package and its associated clasp would not be used, since avoidance of mine neutralization is here being sought. FIG. 30 shows the position of the pass-through device upon receipt of a sweep wire W at either slot, in this case slot 141. FIG. 31 shows the position of device 123 after sweep wire W causes wheel 135 to rotate 180 degrees, and the sweep wire is ready to leave slot 141. Arrows A indicate the direction of movement of sweep wire W. Arrows B indicate the direction of rotation of wheel 135. Alternatively, pass-through device 11, or pass-through device 119, could be used for this purpose.

In a mine countermeasure device according to the present invention, instead of using a single neutralization package, multiple neutralization packages could be deployed from a single mine countermeasure device. Such a mine countermeasure device could be fitted with a magazine containing multiple neutralization packages to thereby extend the operational capability of such a mine countermeasure device. At least two slots would be required in wheel 19 for this purpose, so that an open slot would be available to receive a mooring after another mooring had already been passed through by the other slot.

Although the present invention is particularly well suited for mine countermeasure and minesweep countermeasure applications, it should be understood that the present invention can be utilized for other applications. For example, the present invention could be used by longshoremen to provide equipment to hanging cargo-laden ropes or cables, or to have one such line pass through another such line. A line could be passed through passthrough device while the device is held at least relatively stationary, or the device could be moved against the line so that the line passes therethrough, or both line and passthrough could move. The present invention could also be utilized to provide equipment to a pipe such as on an offshore oil well or well drilling rig.

Some of the many advantages of the present invention should now be readily apparent. For example, a novel apparatus has been provided which is capable of providing equipment to, or passing a line through, a line such as a tensioned cable. Also, a novel apparatus has been provided which allows a line such as a tensioned cable pass through it. Also, a moored mine countermeasure device has been provided which is capable of neutralizing a moored mine in one pass, in poor as well as good visibility and in rough as well as smooth water, and without need for additional marine assets such as a gunboat. This moored mine countermeasure device can be used by surface (e.g. a minesweeper vessel) and airborne (e.g. a helicopter) minesweep assets. In addition, a pass-through device has been provided which is capable of attaching a package to a mooring without cutting the mooring. Furthermore, a minesweep countermeasure device has been provided for making a "friendly" mine resistant to sweeping by an enemy sweep device.

Obviously, many modifications and variations of the present invention are possible in light of the above teachings. It is therefore to be understood that the foregoing embodiments are presented by way of example only and that, within the scope of the appended claims and equivalents thereto, the invention may be practiced otherwise than as specifically described.

What is claimed is:

1. Apparatus for passing a line therethrough, comprising:

a rigid wheel having a center and two sides and including a circumferential projection concentric with the wheel, and at least one radially oriented opening through the projection;

an axle passing through the center of said wheel;

a first member disposed about said wheel and rotatably connected to said axle on each side of said wheel; and a second member contacting said projection of said wheel.

2. Apparatus as recited in claim 1 wherein said first member includes a projection oriented radially away from said axle.

3. Apparatus as recited in claim 1, wherein said opening is generally triangular in shape, with its apex directed away from the periphery of said wheel.

4. Apparatus as recited in claim 3, wherein said apex is sufficiently separated from said axle that a moment can be created between said apex and said axle.

5. Apparatus as recited In claim 1 wherein said first member comprises a clevis connected at one end to said axle on each side of said wheel.

6. Apparatus as recited in claim 5 wherein said clevis is adapted at its other end to be connected to a line.

7. Apparatus as recited in claim 1 wherein said second member engages said projection in a manner permitting rotation of said wheel.

8. Apparatus as recited in claim 7 wherein said second member slidably engages said rim on either side of said wheel.

9. Apparatus as recited in claim 1 wherein said projection comprises a raised rim of said wheel.

10. Apparatus as recited in claim 9 wherein said raised rime is disposed at the perimeter of said wheel and projects from both sides of said wheel.

11. Apparatus as recited in claim 10 wherein said raised rim together with an adjacent portion of said wheel has a T-shaped cross-section.

12. Apparatus as recited in claim 1, further comprising:

a second rigid wheel having a center and two sides and including a circumferential projection concentric with the wheel, and at least one radially oriented opening through the projection, wherein said second wheel is smaller in diameter than said first wheel;

a second axle passing through the center of said second wheel;

a third member disposed about said second wheel and rotatably connected to said second axle on each side of said second wheel;

a fourth member contacting said projection of said second wheel; and retaining means connected to said second member for releasably retaining said fourth member.

13. Apparatus as recited in claim 12, further comprising explosive means connected to third member and to said fourth member and releasably retained by said retaining means.

14. Apparatus as recited in claim 13 wherein said explosive means comprises:

at least one explosive;

a float connected to said at least one explosive; and detonating means for detonating said at least one explosive.

* * * * *